United States Patent [19]

Wachi et al.

[11] Patent Number: 4,548,119

[45] Date of Patent: Oct. 22, 1985

[54] DIGITAL FILTER FOR AN ELECTRONIC MUSICAL INSTRUMENT

[75] Inventors: Masatada Wachi; Mitsumi Katoh, both of Hamamatsu, Japan

[73] Assignee: Nippon Gakki Seizo Kabushiki Kaisha, Hamamatsu, Japan

[21] Appl. No.: 451,880

[22] Filed: Dec. 21, 1982

[30] Foreign Application Priority Data

Dec. 25, 1981 [JP] Japan ..... 56-209109

[51] Int. Cl.[4] ..... G10H 1/02

[52] U.S. Cl. ..... 84/1.19; 84/DIG. 9

[58] Field of Search ..... 84/1.19, 1.22, DIG. 9; 364/724, 572

[56] References Cited

U.S. PATENT DOCUMENTS 4,130,043 12/1978 Niimi ..... 84/1.03
4,267,761 5/1981 Deutsch ..... 84/1.19
4,407,018 9/1983 Kanemasa ..... 364/724
4,416,179 11/1983 Wachi ..... 364/724

*Primary Examiner*—Forester W. Isen
*Attorney, Agent, or Firm*—Spensley Horn Jubas & Lubitz

[57] ABSTRACT

An electronic musical instrument comprises a keyboard, a tone generator and a digital filter. The tone generator bit-serially generates a musical tone signal corresponding to a depressed key on the keyboard. The digital filter bit-serially performs a digital filtering operation of the musical tone signal in accordance with the predetermined amplitude-frequency characteristic. A musical tone is produced based on an output of the digital filter, whereby the characteristic is imparted to the musical tone. This bit-serial processing in the digital filter makes not only the circuit construction of the digital filter itself but also that of the electronic musical instrument incorporating this digital filter smaller and simpler.

18 Claims, 17 Drawing Figures

K
KL
TO L2
LD
SH
L1
FS-OUT
BS-IN
SR1 (LSB)
SR2
SR3
SR4
SR5
SR6
SR7 (MSB)
SR8 (SB)
SHi
KDi
LDi
M1
M2
M3
M4
M5
M6
M7
dFS
FS
FS-IN
BS-OUT
SH1
SH2
SH3
SH8
SH9
24D
32D
A
B
S
Ci
Co+1
D
L
Q

DIGITAL FILTER FOR AN ELECTRONIC MUSICAL INSTRUMENT

BACKGROUND OF THE INVENTION

This invention relates to a digital filter used for imparting a desired tone color to a tone signal to be produced in an electronic musical instrument.

A tone color imparting circuit in an electronic musical instrument requires subtle circuit characteristics and has in most cases been constructed of an analog circuit. The prior art analog tone color imparting circuit, particularly an analog filter, tends to be of a large size. Particularly, in a case where a tone color having a fixed formant (e.g., human voice, wind instruments such as oboes and basoons, piano and stringed instruments) is to be realized, a large number of analog filter circuits must be provided in parallel resulting in a circuit construction of a large size. Besides, a digital tone signal cannot be applied to the analog tone color circuit directly so that application of a digital tone generation circuit requires an extra process. More specifically, a digital to analog converter must be provided between the digital tone generation circuit and the analog tone color circuit. Such digital to analog converter must be provided for each of channels which require different tone color processings (i.e., filter processings) and, accordingly, a large number of digital to analog converters are required for the entire system.

It is, therefore, an object of this invention to provide a system for imparting a tone color in an electronic musical instrument which is capable of easily realizing a fixed formant with a compact and inexpensive construction and to which a digital tone generation circuit is readily applicable. As a device for meeting such purpose, there is a digital filter. A circuit including a digital filter can be constructed of an LSI. A problem posed by reduction in the size of the LSI circuit is reduction in the number of connecting pins and the number of wirings.

It is therefore another object of the invention to reduce the number of wirings and the number of connecting pins required for supplying digital signals to a digital filter.

As a prior art of an electronic musical instrument incorporating a digital filter, there is U.S. Pat. No. 4,130,043 entitled "Electronic musical instrument having filter-and-delay loop for tone production". Since, however, the digital filter operation in this prior art device is performed in bit-parallel, the construction of the digital filter circuit and its peripheral circuits as well as wirings and connectors tends to become large and complicated. It is therefore another object of the invention to make the circuit construction smaller and simpler by bit-serially performing the operation or process of the digital filter incorporated in the electronic musical instrument.

Filter circuits must generally be provided individually for respective channels which require different filter processings. Provision of the filter circuit for each of the channels necessitates a bulky construction and a high cost of manufacturing. It is therefore still another object of the invention to make hardware of the digital filter compact and economical in a case where filter processings for plural channels are required.

SUMMARY OF THE INVENTION

For achieving these and objects of the invention, it is a feature of the digital filter of this invention to comprise a calculation circuit to which digital tone signals to be filtered and filter coefficient data for establishing a tone color are timewisely serially supplied and in which a predetermined filter operation is carried out in accordance with the timewisely serially supplied digital tone signals and filter coefficient data. By employing the digital filter as a circuit for imparting a tone color to the tone signals, a desired fixed formant can be readily realized and digital tone signals can be directly applied to the digital filter. As a result, necessity for providing a digital to analog converter can be eliminated and the circuit construction can be simplified. Further, by introducing an LSI version of the digital filter, a compact and inexpensive circuit design of the digital filter can be realized. Since the system of the invention is constructed in such a manner that both the tone signals and the filter coefficients are serially supplied to the digital filter, the number of wirings in the integrated circuit can be greatly reduced.

According to the invention, the digital tone signals in plural channels to be treated with different filter processings are time division multiplexed in being supplied to the digital filter. Likewise, the filter coefficients for the respective channels are time division multiplexed in synchronism with the time division timings of the tone signals in being supplied to the digital filter. Accordingly, the digital filter may have hardware for only a single channel and this contributes to a further compact design and low manufacturing cost.

The digital filter should preferably be of a serial calculation type which performs arithmetic operation of the filter coefficients on the timewisely serially supplied digital tone signals while maintaining their serial form, i.e., performs a serial operation. By this arrangement, the number of operation elements such as adders and multipliers can be reduced to one which is much smaller than the bit number of the digital tone signal for one sample point thereby contributing to realization of a compact circuit design.

BRIEF DESCRIPTION OF THE DRAWINGS

In the accompanying drawings,

FIGS. 5(*b*) and 5(*c*) are block diagrams showing examples of equivalent circuits of the basic form of the lattice type digital filter;

DESCRIPTION OF A PREFERRED EMBODIMENT

Figure 1:
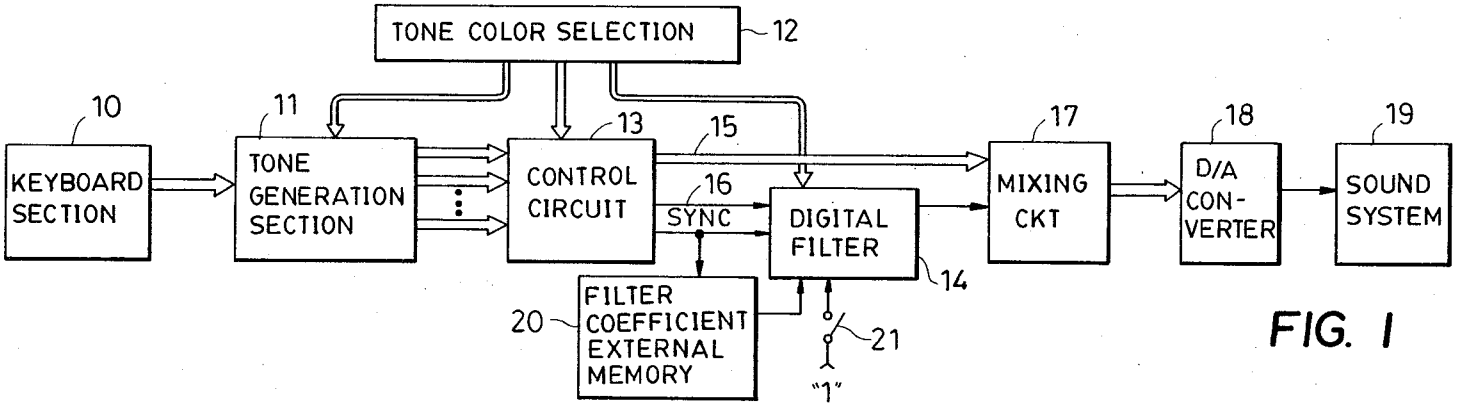
FIG. 1 is a block diagram of an entire construction of an electronic musical instrument incorporating an embodiment of the invention.

Referring to FIG. 1, a keyboard section 10 comprises, for example, an upper keyboard, a lower keyboard and a pedal keyboard. A tone generation section 11 generates a tone signal corresponding to the depressed key of the keyboard section 10 and is capable of generating tone signals in a plurality of channels in response to the type of keyboards, the tone colors and the like. A tone color selection device 12 comprises numerous switches for selecting the tone color of each keyboard, various effects and the like. A predetermined one of the outputs of the tone color selection device 12 is applied to the tone generation section 11 to control the tone signal generation operation in the generation section 11. The tone generation section 11 outputs tone signals for a plurality of channels corresponding to the types of keyboards and tone colors channel by channel in parallel in a digital form. While a tone signal for each channel is of course provided with a predetermined tone color in the tone generation section 11 in response to the tone selection in the tone color selection device 12, the tone color providing operation is not complete in some channels. The tone signals in such channels are subjected to the tone color control effected at a later stage by a digital filter section 14. For example the tone colors having a constant spectrum distribution regardless of the tone pitch (i.e., movable formant type tone colors) are provided by the tone generation section 11 whereas fixed formant type tone colors are provided by the digital filter section 14. However, some movable formant type tone colors such as low frequency characteristics of brass tones, complicated characteristics of string tones, etc. preferably are amended in their spectrum distributions by further subjecting them to the fixed formant type filter control. The digital filter section 14 may also be used to provide such tone colors.

The digital tone signals for the respective channels outputted from the tone generation section 11 are applied to a tone signal distribution accumulation and serial conversion control circuit 13. A predetermined one of the outputs of the tone color selection device 12 is applied to this control circuit 13. In response to the tone color selection data supplied from the tone color selection device 12, the control circuit 13 sorts out the tone signals for those channels which can be accumulated from the tone signals for the other channels which need to be passed through the digital filter section 14. Then the control circuit 13 accumulates (mixes) those tone signals which can be accumulated and outputs them into a line 15 whereas it timewise serializes those parallel digital tone signals for the respective channels that need to be passed through the digital filter section 14 and time division multiplexes the obtained serial digital tone signals by the respective channels, thereby outputting the thus multiplexed signals into a single line 16. To timewise serialize the digital tone signals and supply them to the digital filter section 14 is advantageous in that the calculation circuit in said filter section 14 can thus be a serial calculation circuit and the filter section may therefore be simple in contruction. Further, time division multiplexing the digital tone signals for a plurality of channels so as to put them into a common line obviates the necessity to expressly provide a digital filter for each channel, thereby simplifying the construction of the digital filter section 14.

The table below gives an example of channels and shows how they are sorted out by the control circuit 13. The "mono/poly" column indicates the distinction between the monophonic tone generation channel and the polyphonic tone generation channel. In the case of the polyphonic tone generation channels, the tone generation section 11 of course adds and mixes the digital tone signals of plural tones and outputs a single-channel tone signal. The characters ch1, ch2, ch3 and ch4 in the "distribution" column designate filter channels and are used as reference characters for the respective channels in describing the time division processing of the tone signals for the respective channels by the digital filter section 14.

TABLE 1

| CHANNELS | mono/ poly | | DISTRIBUTION |
|---|---|---|---|
| upper keyboard fluit | poly | | accumulation |
| lower keyboard orchestra | poly | | |
| pedal keyboard | mono | | |
| upper keyboard solo | mono | ch1 | to the digital filter section |
| upper keyboard special | poly | ch2 | |
| upper keyboard custom | mono | ch3 | |
| lower keyboard special | poly | ch4 | |

The tone signals through the line 15 are directly supplied to a mixing circuit 17 while the tone signals through the line 16 are supplied to the mixing circuit 17 through the digital filter section 14. The mixing circuit 17 mixes (digitally adds) the tone signals that were filtered by the digital filter section 14 and the tone signals from the line 15 that were not filtered. Since the filtered tone signals, each signal being bit-parallel, have been bit-serialized, these serial tone signals are converted to parallel signals for the respective channels before said mixing. The distribution, addition, and parallel to serial conversion operations by the control circuit 13 and the serial-to-parallel conversion operation by the mixing circuit 17 can be easily realized by known digital technique and therefore will not be described in detail. The digital tone signal outputted from the mixing circuit 17 is converted to an analog signal by a digital to analog converter 18 and supplied to a sound system 19.

A predetermined one of the outputs of the tone color selection device 12 is applied to the digital filter section 14 so that the filter characteristics of the channels ch1, ch2, ch3 and ch4 may be individually set in response to the tone selection. Therefore, the filter section 14 comprises a filter coefficient internal ROM (ROM represents read-on memory and will be used as such hereinafter) from which a predetermined filter coefficient is read out in response to the tone color selection data and used in the filter section 14. Apart from this filter coefficient internal ROM is provided a filter coefficient external memory 20 which may be a semiconductor memory or may comprise a detachable memory media such as a magnetic card. The filter coefficient read from the exterior memory 20 is applied to the digital filter section 14. A filter coefficient selection switch 21 is provided in association with the digital filter section 14 to select one of the internal ROM and the external memory 20. The filter section 14 effects its filter control according to the filter coefficient read from the selected memory. The filter coefficients to be stored in the exterior memory 20 include, for example, a filter coefficient that changes with time. A large memory capacity is required to allow a filter coefficient to change with time so an external memory is suited for that purpose.

The control circuit 13 outputs a synchronizing pulse SYNC in response to the reference timing of the serial outputting of the tone signals to the line 16. This synchronizing pulse SYNC is applied to the digital filter section 14 and external memory 20 and used to serialize (serially read) filter coefficients in synchronism with the serial tone signal of the line 16 and control the synchronization of the serial calculation timing in the filter section 14.

Figure 2:
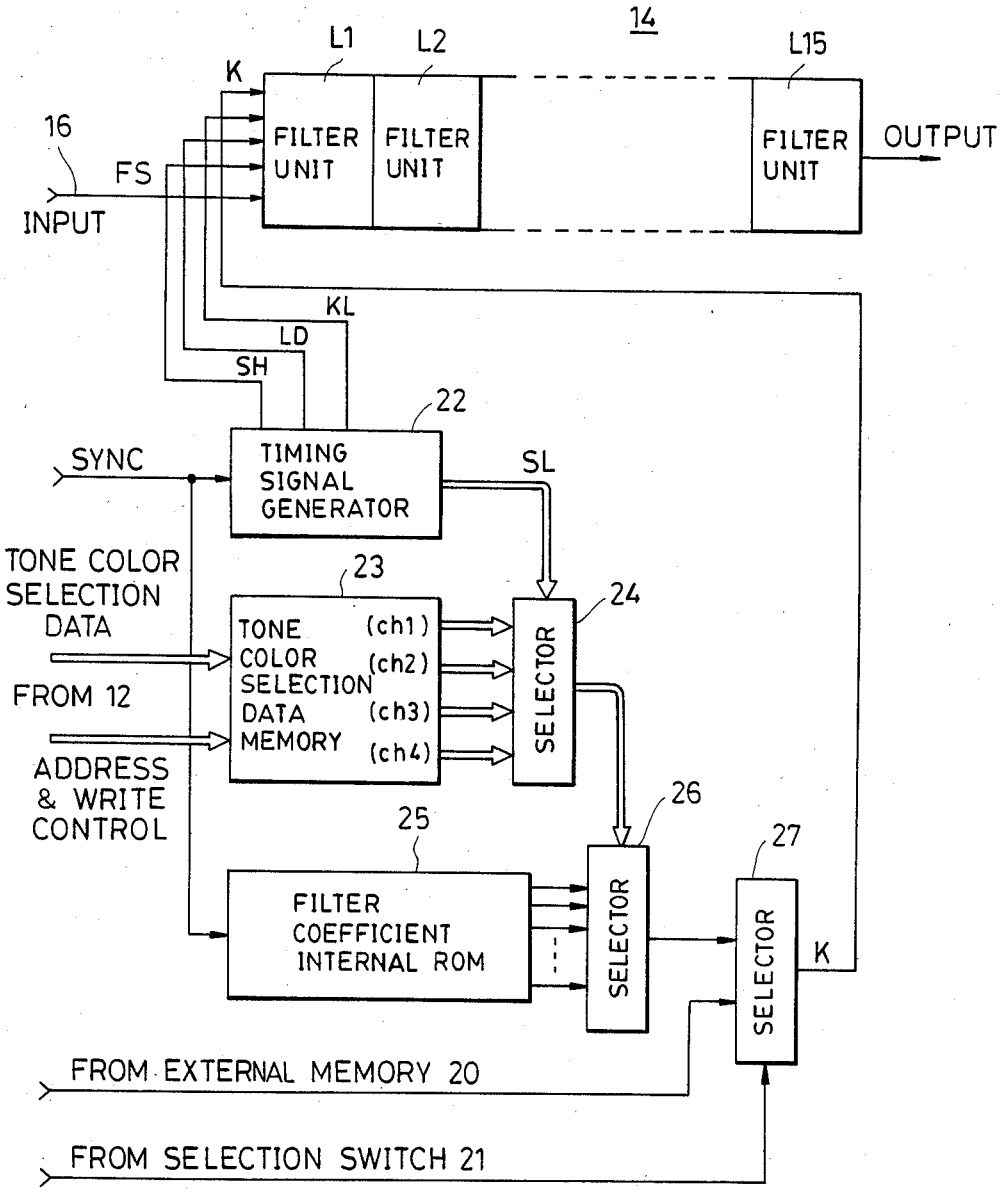
FIG. 2 is a block diagram showing an example of the interior construction of a digital filter section shown in FIG. 1.

FIG. 2 shows an example of the digital filter section 14 which comprises a digital filter main circuit consisting of 15 serially connected filter units L1 to L15, and circuits 22 to 27 to supply filter coefficients and calculation control timing signals to this main circuit.

Figure 3:
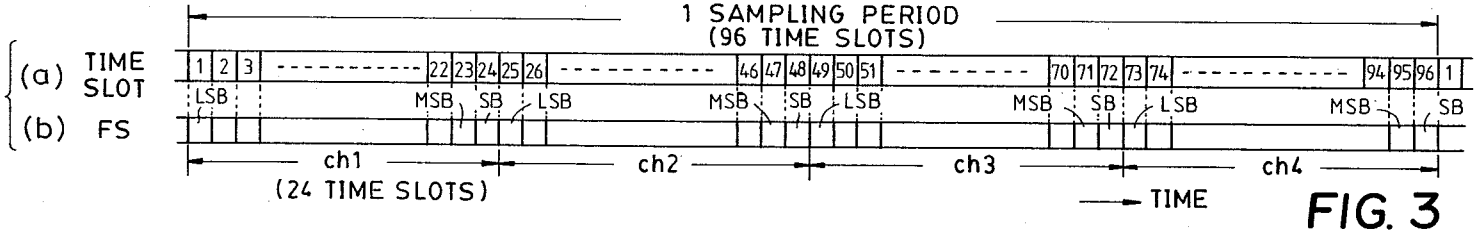
FIG. 3 is a time chart showing an example of timewisely serial production of digital tone signals.

The serial tone signal (designated as FS) supplied through the line 16 from the control circuit 13 shown in FIG. 1 is inputted to the 1st-stage filter unit L1. One tone signal, for example, consists of 24-bit digital data. In the case of the serial tone signal FS of the line 16, its 24-bit data is serialized using 24 time slots and the 24-time-slot serial data for four channels is time division multiplexed. Therefore, one sampling period in the tone waveform amplitude of the serial tone signal FS is 96 time slots. In FIG. 3(*a*), the successive time slots in this one sampling period are assigned numbers 1 through 96 respectively. FIG. 3(*b*) shows that in the serial tone signal FS of the line 16, the serial tone signal data of the channel ch1 is allotted to the 1st through 24th time slots, the serial tone signal data of the channel ch2 to the 25th through 48th time slots, the serial tone signal data of the channel ch3 to the 49th through 72nd time slots, and the serial tone signal data of the channel ch4 to the 73rd through 96th time slots. In each of the 24-time slot tone signal data, the first time slot (the first, 25th, 49th and the 73rd time slots) is assigned with the least significant bit LSB, followed by the more significant bits in order with the weight increasing as the stage advances until the 23rd time slot (the 23rd, 47th, 71st and the 95th time slots) is assigned with the most significant bit and the last time slot (the 24th, 48th, 72nd, and 96th time slots) is assigned with the sign bit.

The timing signal generator 22 generates predetermined timing signals KL, LD, and SH based on the synchronizing pulse SYNC and also generates a selection signal SL to control the time division outputting of the filter coefficients. Suppose one filter coefficient is, for example, an 8-bit digital data, since such a filter coefficient is necessary for each of the filter units L1 to L15, the filter coefficients corresponding to one tone color has $8\times15=120$ bits in all. Therefore, the serial outputting of the filter coefficients for one tone color (one channel) requires 120 time slots and the time division outputting of the filter coefficients for four channels requires $120\times4=480$ time slots. The filter coefficients serial time division outputting period (480 time slots) corresponds to five serial-tone-signal sampling periods ($480\div96=5$). The selection signal SL consists of four kinds of code signals for selecting the filter channels ch1, ch2, ch3, and ch4, these code signals successively occurring, each during 120-time-slot time width for one filter channel.

A tone color selection data memory 23 stores the tone color selection data supplied from the tone color selection device 12 (FIG. 1) and is capable of both writing and reading. This memory 23 has memory locations corresponding to the channels ch1, ch2, ch3, and ch4 and stores the tone color selection data indicating the tone color selected in each channel in the corresponding memory location. Specifically, when a certain tone color was selected in a channel, the tone color selection memory 12 supplies the tone color selection data designating that tone color, the data designating that channel (i.e., the address in the memory 23) as well as write order and, based on these data, the tone color selection data is stored at the memory location in the memory 23 corresponding to said channel. The stored tone color selection data of the channels ch1 to ch4 is read out from the memory 23 in parallel at all times and inputted to the selector 24. The selector 24 successively selects the tone selection data of the respective channels in response to the selection signal SL on a time shared basis (every 120 time slots).

The filter coefficient internal ROM 25 has in itself stored beforehand groups of filter coefficients corresponding to the tone colors available for selection in the tone color selection device 12. As before, a group of 15 filter coefficients corresponds to one tone color and one filter coefficient has eight bits so one group of filter coefficients is 120-bit data. The ROM 25 reads out groups of 120-bit filter coefficients bit by bit successively and timewise serially, based on the synchronizing pulse SYNC at a given timing. Besides, the ROM 25 carries out the serial reading in respect of all the tone colors in parallel simultaneously. The filter coefficient serial data for the respective tone color thus read out from the ROM 25 is inputted to the selector 26. The selection control input of the selector 26 is supplied with tone color selection data of the respective channels selected by the selector 24 on a time shared basis. The selector 26 selects a group of serial filter coefficient data corresponding to the contents (tone color) of the tone color selection data supplied to the selection control input from among the serial filter coefficient data for the respective tone colors supplied in parallel from the ROM 25. In synchronism with the 120-time-slot time width during which the tone color selection data for a channel is being supplied to the selector 26, the ROM 25 serially reads out 120-bit filter coefficients. Therefore the selector 26 outputs four groups of filter coefficient serial data corresponding to the tone colors selected in the channels ch1, ch2, ch3, and ch4 on a time shared basis in every 120 time slots. The output of the selector 26 is applied to one of the inputs of the selector 27. The other input of the selector 27 is supplied with the filter coefficients read from the external memory 20 (FIG. 1). The state of the filter coefficients supplied from the external memory 20 is totally identical to that of the filter coefficients outputted from the selector 26 and corresponds to the time-division-multiplexed serial data for four channels. The control input of the selector 27 is supplied with the output of the filter coefficient selection switch 21 (FIG. 1) so that the selector 27 may select one of the outputs from the selector 26 (i.e., from the interior ROM 25) and the exterior memory 20 in response to ON and OFF of the switch 21. The serial filter coefficient data K thus selected by the selector 27 is inputted to the 1st-stage filter unit L1. The timing signals KL, LD, and SH generated by the timing signal generator 22 also are inputted to the 1st-stage filter unit L1.

Figure 4:
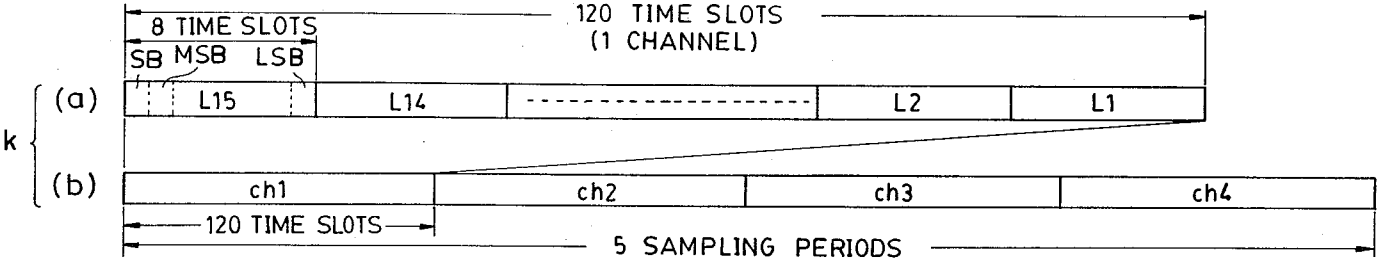
FIG. 4 is a time chart showing an example of timewisely serial production of filter coefficients.

FIG. 4 indicates the state of the serial filter coefficient data K, FIG. 4(*a*) showing its state for one channel and FIG. 4(*b*) for four channels. As shown in FIG. 4(*a*), the filter coefficient data K for one channel is outputted such that the filter coefficient corresponding to the last-stage filter unit is first outputted, followed by the filter coefficient corresponding to L15, L14. . . L1 in this order whereas in each of the 8-bit filter coefficients, the sign bit SB is first outputted, followed by the other bits in order of significance from the MSB. The data K is shifted through the serially connected filter units L1 to L15 in turn successively. When the coefficients of the data K each corresponding to the filter units L15, L14. . . L1, outputted in this order, have been shifted to the respective units as shown in FIG. 4(*a*), these coefficients of the data K are latched in the respective units L15 to L1. The data K, of which the portion corresponding to one channel is shown in detail in FIG. 4(*a*), is time division multiplexed in the order of the channels ch1, ch2, ch3, and ch4 as illustrated in FIG. 4(*b*). Thus the time in which the serial filter coefficient data K for all the channels ch1 to ch4 successively occurs corresponds to five sampling periods of the serial tone signal FS.

The digital filters used for the digital filter units L1 to L15 may be of any type. Known basic types of digital filters includes the lattice type filters, transversal type filters and ladder type filters, etc. The lattice type filter in particular is known as suited for sound synthesizing. Besides, the lattice type filter needs fewer multipliers than the other types so the hardware can be reduced in size. Further, the lattice type filter requires the filter coefficients to have but a small number of bits. With the lattice type, moreover, the coefficient setting manner for desired filter characteristics is established. Therefore, in this embodiment, the lattice type filters will be used for the digital filter units L1 to L15 as a preferred example.

Figure 5:
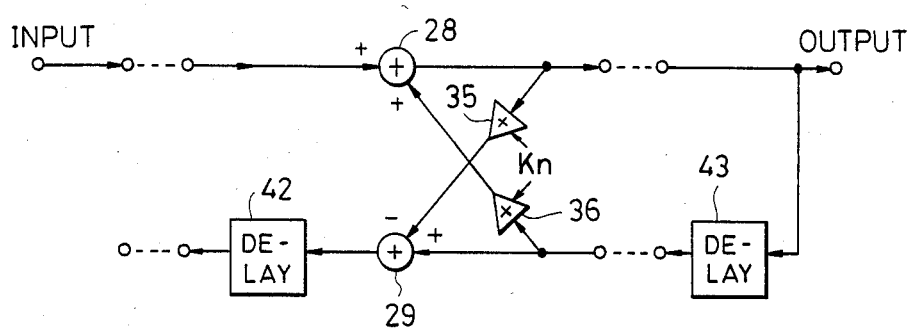
FIG. 5(*a*) is a block diagram showing a basic form of a lattice type digital filter.
Figure 5:
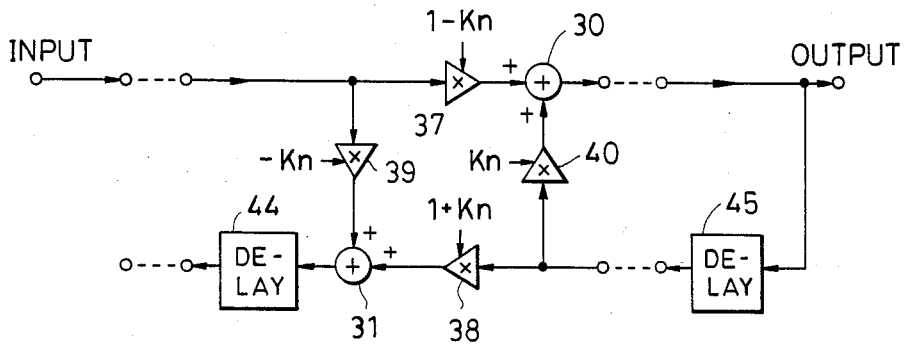
Figure 5:
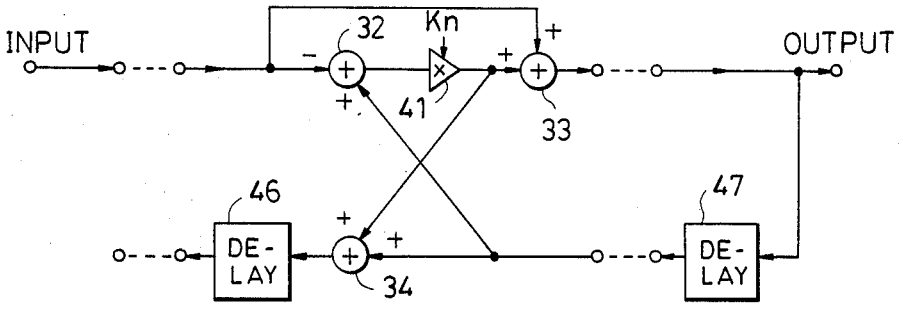

A basic model of the lattice type filter is shown in FIG. 5(*a*). FIG. 5(*b*) and (*c*) shows equivalent modifications of that basic model. In FIG. 5, the numerals 28 to 34 designate adders or subtracters, 35 to 41 multipliers, and 42 to 47 delay circuits. An appropriate number of filter units as shown are serially connected to form a filter circuit. Kn, −Kn, 1−Kn, and 1+Kn designate filter coefficients to be multiplied by the respective multipliers, the n indicating that the coefficient corresponds to the n-th stage filter unit. The delay circuits 43, 45, and 47 on the output side are provided to set the time delay corresponding to one tone signal sampling period between the output of the last-stage filter unit and its feedback input. The delay circuits 42, 44, and 46 within the respective filter units also are provided to set the delay time corresponding to one sampling period. Since these delay circuits 42, 44, and 46 are provided to feed back the signal that occurred one sampling period before to the immediate earlier-stage filter unit, the delay time really set in the circuit is the time obtained by subtracting the time delay in the calculation circuit from one sampling period. In the lattice type filters shown in FIG. 5, the model (c) requires the fewest multipliers.

Figure 6:
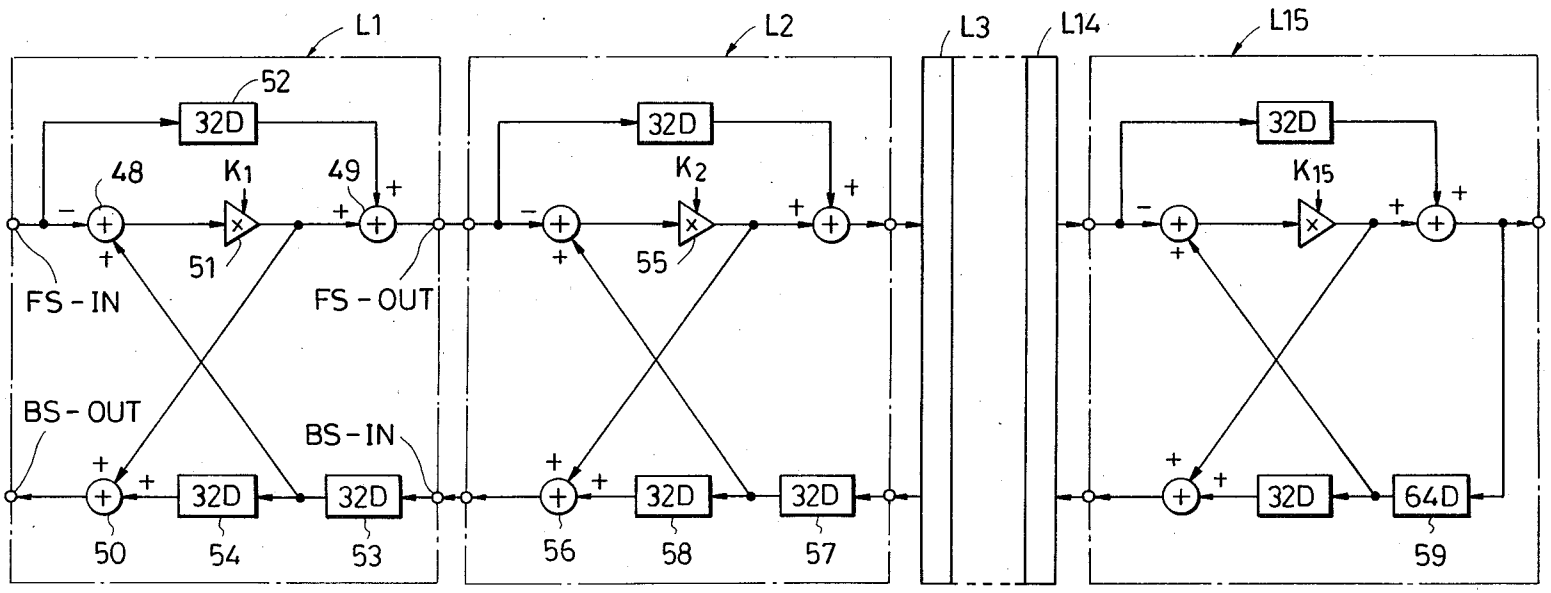
FIG. 6 is a block diagram showing an example of a filter unit in FIG. 2 constructed of the lattice type filter.

FIG. 6 illustrares the filter units L1 to L15, shown in FIG. 2, formed of the lattice type filters as shown in FIG. 5(*c*). In the 1st-stage filter unit L1 shown in FIG. 6, the numerals 48, 49, and 50 designate adders or subtractors, 51 a multiplier, and 52, 53, and 54 delay circuits. The characters 32D in the blocks of the delay circuits 52, 53, and 54 indicate that these circuits each effect a 32-time slot delay. FS-IN denotes a tone signal input terminal, FS-OUT a tone signal output terminal, BS-IN a feedback signal input terminal, and BS-OUT a feedback signal output terminal. The other units L2 to L14 but the last-stage unit L15 are of the same construction as the unit L1. The tone signal output terminals FS-OUT of the units L1 to L14 are connected to the tone signal input terminals FS-IN of the respectively following units L2 to L15 while the feedback signal output terminals BS-OUT of the units L2 to L15 are connected to the feedback signal input terminals BS-IN of the respectively preceding units L1 to L14.

The adder 48 (working as a subtractor) in the filter unit L1 subtracts the tone signal inputted from the input terminal FS-IN from the tone signal fed back from the next-stage unit L2 through the terminal BS-IN and delay circuit 53. The output of the adder 48 is inputted to the multiplier 51 and multiplied by the filter coefficient $K_1$. The numeral 1 added to the letter K indicates that the coefficient corresponds to the 1st-stage unit L1. The output of the adder 51 is supplied to the adder 49 and thereby added to the input tone signal supplied through the terminal FS-IN and delay circuit 52. The delay circuit 52 is provided in view of the operation time delay in the multiplier 51. Specifically, since in this example, the multiplier 51 is designed so that its operation time delay is equivalent to 32 time slots, the delay circuit 52 effects 32-time-slot delay for synchronism. The output of the adder 49 is inputted to the next-stage unit L2 through the output terminal FS-OUT.

Between the output of the adder 48 and the signal fed back to the adder 48 from the next-stage unit L2 through the delay circuit 53, the time delay equivalent to one sampling period needs to be secured and is obtained as follows. The tone signal through the multiplier 55 and adder 56 in the unit L2 is inputted to the feedback signal input terminal BS-IN of the unit L1. The signal is then inputted through the delay circuit 53 to the adder 48. Accordingly, the output signal of the adder 48 is 32 time slots delayed by the multipler 51, then another 32 time slots by the multiplier 55 in the next-stage unit and further 32 time slots by the delay circuit 53 so as to be delayed by 96 time slots in all before being fed back to the adder 48. The required delay time is therefore secured since, as before, one sampling period of the serial tone signal FS is 96 time slots.

The adder 50 (or 56 for L2) supplying a signal to the feedback signal output terminal BS-OUT adds the output of the multiplier 51 (or 55 for L2) and the feedback signal supplied from the next-stage unit L2 (L3 for L2) through the delay circuits 53 and 54 (57 and 58 for L2). The output of the multiplier 51 corresponding to the output of the delay circuit 53 is 32 time slots behind the output timing of the circuit 53. The delay circuits 54 is therefore provided to develop the equivalent time delay.

The last-stage unit L15 feeds back to itself its output tone signal. Therefore, since the 32-time-slot time delay in the multiplier of the next-stage unit cannot be expected, the time delay in the delay circuit 59 is set at 64 time slots.

FIG. 6 only shows a basic construction of the filter units L1 to L15 and omits the circuits relating to the timing signals KL, LD, and SH, circuits relating to the serial filter coefficient data K, circuits enabling serial operation as well as time division filter operation to be performed, and the like. A specific example of the filter units L1 to L15 with a basic construction as shown in FIG. 6 will now be described with reference to FIG. 7.

Figure 7:
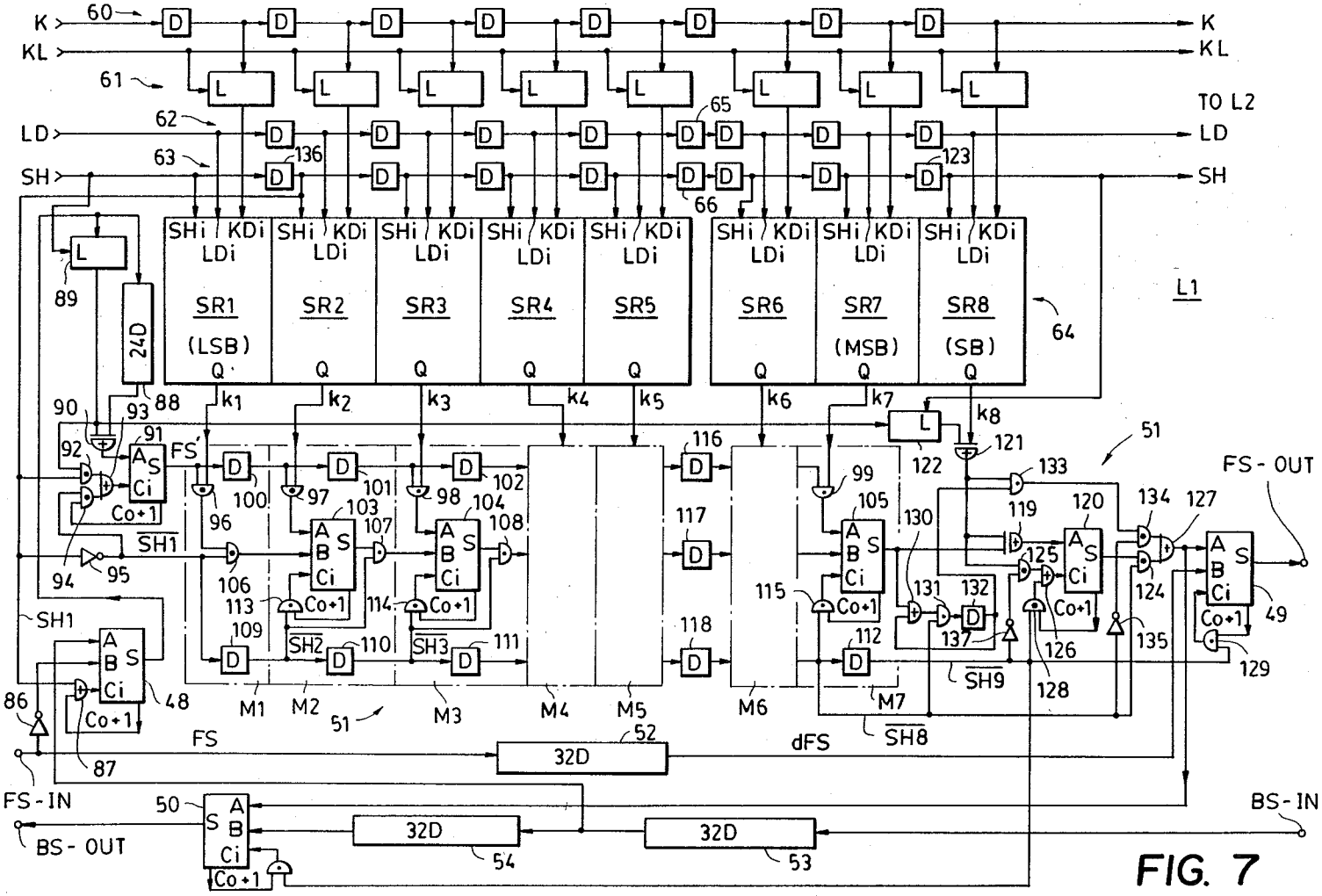
FIG. 7 is a circuit diagram showing an example of one filter unit in FIG. 7 in detail.

FIG. 7 illustrates a specific example of the 1st-stage filter unit L1. The other filter units L2 to L15 are of exactly or substantially the same construction as the unit shown. The circuits in FIG. 7 corresponding to the adders 48, 49, and 50 and delay circuits 52, 53 and 54 in FIG. 6 are designated by the same reference numerals. The circuit section in FIG. 7 corresponding to the multiplier 51 in FIG. 6 is designated generally by the same numeral.

The circuits relating to the timing signals KL, LD, and SH and the serial filter coefficient data K, omitted in FIG. 6, are included in FIG. 7. Description will first be made of these circuits. The delay circuits that effect a 1-time-slot delay are shown by the letter D in their blocks without reference numerals added unless these reference numerals are necessary for explanation. A delay circuit train 60 consisting of serially connected eight 1-time-slot delay circuits (i.e. 8-stage serial-shift-parallel-output type register) and a latch circuit 61 consisting of eight 1-bit type latch circuits to which the outputs of the individual circuits of the delay circuit train 60 are respectively inputted are provided to serial-to-parallel convert the serial filter coefficient data K. The serial filter coefficient data K is inputted to the delay circuit train 60 so as to be successively shifted through each of the delay circuits and, after being delayed by eight time slots, supplied to the next-stage unit L2. The timing signal KL is applied to the latch control inputs (L) of the latch circuit 61, enabling the individual latch circuits to latch the outputs of the respective delay circuits of the delay circuit train 60 when the signal KL is a 1. It is assumed that in this example, the output timing of the latch circuit 61 is one time slot behind the latch timing. The numerals 62 and 63 denote delay circuit trains formed of serially connected eight 1-time-slot delay circuits (serial-shift-parallel-output type shift register) similar to the circuit train 60. The timing signals LD and SH are inputted respectively to the delay circuit trains 62 and 63 and successively shifted so as to be delayed by eight time slots and supplied to the next-stage filter unit L2.

Similar circuits to the delay circuit trains 60, 62, and 63 and the latch circuit 61 are provided in the other filter units L2 to L15. Therefore, the serial filter coefficient data K and timing signals LD and SH are sequentially delayed by the filter units L1 to L15, eight time slots by each unit. The timing signal KL is supplied to the filter units L1 to L15 simultaneously without being delayed.

Figure 8:
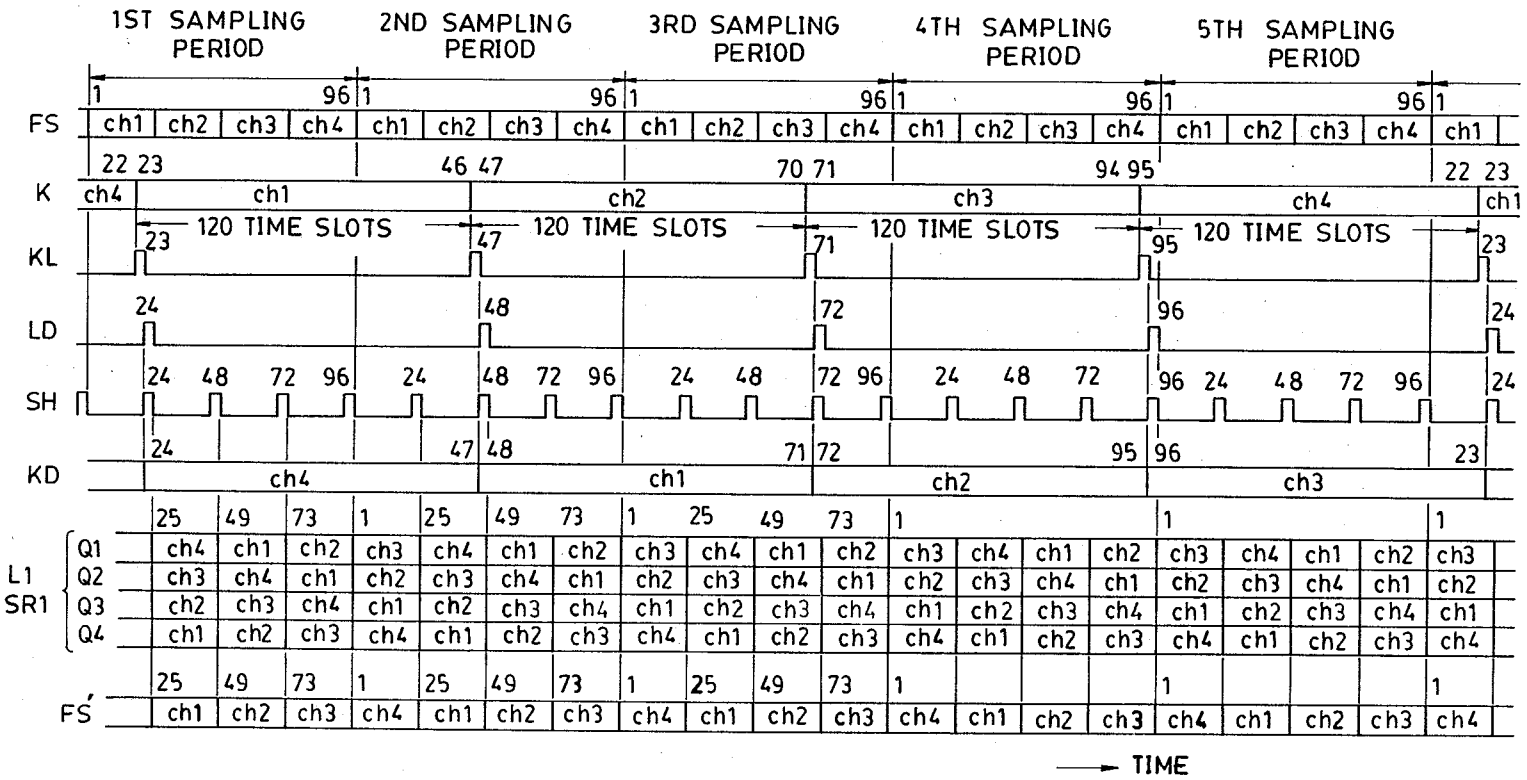
FIG. 8 is a time chart showing generally an example of generation of principal signals appearing in FIG. 7.

FIG. 8 shows the pulse generation timings of the timing signals KL, LD, and SH supplied from the timing signal generator 22 (FIG. 2) to the 1st-stage filter unit L1. FIG. 8 also shows the stage of the serial tone signal FS, which is supplied to the 1st-stage filter unit L1 through the line 16, in respect of the channels ch1, ch2, ch3, and ch4. FIG. 8 further shows the state of the serial filter coefficient data K, which is supplied to the 1st-stage filter unit L1, in respect of the channels ch1, ch2, ch3, and ch4. In FIG. 8, the numerals added to the signal waveform diagram indicate the numbers allotted to the time slots (FIG. 3(*a*)) in one sampling period. The signals FS and data K shown in FIG. 8 are illustrated in detail in FIGS. 3(*b*), and 4(*a*), respectively.

The serial filter coefficient data K and timing signals KL and LD are generated so as to have a cycle corresponding to five sampling periods of the tone signals FS. Naming said five sampling periods the 1st to 5th sampling periods each, the timing signal KL is a signal of which the pulses occur at the 23rd time slot of the first sampling period, at the 47th time slot of the second sampling period, at the 71st time slot of the third sampling period, and at the 95th time slot of the fourth sampling period at a cycle of 120 time slots. The timing signal LD is a similar signal to KL and its pulses occur at a cycle of 120 time slots but each pulse of LD occurs one time slot behind that of KL. In the serial filter coefficient data K, as before, the filter coefficients for one channel are assigned 120 time slots. Specifically, the filter coefficients K for the channel ch1 are assigned the 120 time slots from the 23rd time slot of the first sampling period to the 46th time slot of the second sampling period, thereafter the coefficients K for the channels ch2, ch3, and ch4 being successively assigned in order every 120 time slots in synchronism with the timing of the signal KL. The timing signal SH occurs at a cycle of 24 time slots or at the 24th, 48th, 72nd, and 96th time slots, repeatedly.

As can be seen from FIG. 8, the timing signal KL occurs upon completion of the serial outputting of the filter coefficient data K for one channel. As shown in FIG. 4(*a*), the serial filter coefficient data K for one channel is outputted such that the filter coefficients corresponding to the filter units L15, L14. . . L1 are outputted in this order successively. Therefore, upon occurrence of the timing signal KL, the 8-bit filter coefficients each corresponding to the filter units L1 to L15 are just located in the delay circuit trains (see 60 in FIG. 7) of the respective units so as to be latched in the latch circuits (see 61 in FIG. 7) of the respective units. Thus the serial filter coefficient data K is converted into parallel data by the filter units L1 to L15. The parallel data is held in the latch circuits (61 in FIG. 7) until the next latch timing. For example, upon occurrence of the timing signal KL at the 23rd time slot in the first sampling period, the filter coefficient data for the channel ch4 is latched in the latch circuits (61 in FIG. 7) of the units L1 to L15 and held until the timing signal KL occurs at the 47th time slot in the second sampling period. Accordingly, the latch circuits 61 output the filter coefficients for the channels ch1 to ch4 at a timing as shown KD in FIG. 8.

In FIG. 7, a filter coefficient memory 64 stores the filter coefficients for the respective channels ch1 to ch4 and supplies them to the multiplier 51 at a timing of the serial tone signal FS. The memory 64 consists of eight shift registers SR1 to SR8 corresponding to the respective bits of a filter coefficient. The outputs of the latch circuit 61 that has latched each bit of an 8-bit filter coefficient are supplied to the respective KDi inputs of the shift registers SR1 to SR8. Among the shift registers SR1 to SR8, SR1 corresponds to the least significant bit (LSB), SR7 to the most significant bit (MSB), and SR8 to the sign bit (SB), of a filter coefficient. It is to be noted that the 8-bit filter coefficient data is represented in the sign and magnitude form with the lower seven bits expressing the absolute value of the filter coefficient and the sign bit (SB) which is a higher bit the sign of the coefficient (a "0" meaning that the coefficient is positive and "1" negative). It is assumed that the MSB of the coefficient or the bit corresponding to the shift register SR7 has a weight of decimal 0.5.

The timing signals SH and LD are inputted to the SHi input and LDi input of the shift register SR1, respectively. Further, the signals LD and SH successively delayed by the delay circuit trains 62 and 63 are respectively inputted to the SHi inputs and LDi inputs of the shift registers SR2 to SR8. The 5th-stage delay circuits 65 and 66 in the delay circuit trains 62 and 63 do not provide outputs to any registers since these circuit trains are only provided in view of the calculation time delay, to be described later, in the multiplier 51.

Figure 9:
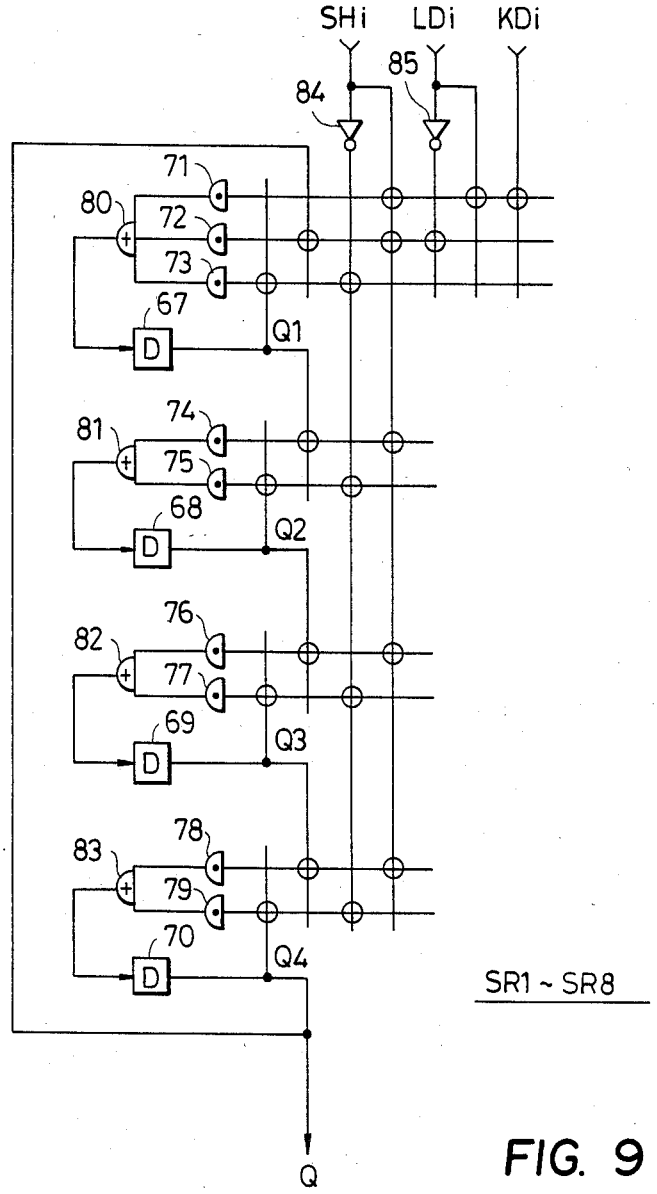
FIG. 9 is a circuit diagram showing an example of the interior construction of a shift register for storing filter coefficients shown in FIG. 7.

Each of the shift registers SR1 to SR8 is constructed as shown in FIG. 9. Four 1-time-slot delay circuits 67, 68, 69, and 70 form a 4-stage shift register. KDi is a data input, LDi a new data load control input, and SHi a shift control input. New data applied to the KDi input is loaded into the 1st-stage delay circuit 67 through an AND gate 71 and OR gate 80 when the LDi input and SHi input are both supplied with the signal 1. When the signal to the SHi input is a "0", the signal inverted by an inverter 84 is a "1", which enables AND gates for holding 73, 75, 77, and 79 so that the outputs of the delay circuits 67, 68, 69 and 70 are self-held through these AND gates 73, 75, 77, and 79 and OR gates 80, 81, 82 and 83. When the signal to the SHi input is a "1", the AND gates for holding 73, 75, 77, and 79 are disabled and AND gates for shifting 72, 74, 76, and 78 enabled so the output Q1 of the 1st-stage delay circuit 67 is shifted to the 2nd-stage delay circuit 68, the output Q2 of the 2nd-stage delay circuit 68 to the 3rd-stage delay circuit 69, the output Q3 of the 3rd-stage delay circuit 69 to the 4th-stage delay circuit 70, and the output Q4 of the 4th-stage delay circuit 70 to the 1st-stage delay circuit 67. The signal to the LDi input is on one hand inverted by an inverter 85 and inputted to the AND gate 72, thereby inhibiting the output Q4 of the 4th-stage from being shifted to the 1st-stage when new data is loaded into the 1st-stage delay circuit 67. Thus each time (every 120 time slots) the signal "1" based on the timing signal LD is applied to the LDi inputs, filter coefficient data is loaded from the latch circuit 61 (FIG. 7) into the first stages of the shift registers SR1 to SR8 whereas each time (every 24 time slots) the signal "1" based on the timing signal SH is applied to the SHi inputs, the data in each stage of the shift registers SR1 to SR8 is shifted to the next stage.

In the case of the shift register SR1 of the 1st-stage filter unit L1, for example, it is when the timing signal LD is generated that the filter coefficient data of the latch circuit 61 is loaded through the KDi input into the 1st-stage delay circuit 67. Specifically, the 1st-stage delay circuit 67 is loaded with the filter coefficient data for the channel ch4 at the 24th time slot in the first sampling period, the data for the channel ch1 at the 48th time slot in the second sampling period, the data for the channel ch2 at the 72nd time slot in the third sampling period, and the data for the channel ch3 at the 96th time slot in the fourth sampling period (see LD, KD, and SR1 of L1 in FIG. 8). Since the timing signal SH occurs five times in one cycle of the timing signal LD, the shifting is effected five times in the shift register SR1. Therefore, the data for the channel ch4 that was loaded into the 1st-stage delay circuit 67 at the 24th time slot in the first sampling period is shifted to the 2nd, 3rd, 4th, and 1st stage in order each time the signal SH occurs at the 48th, 72nd, 96th, and 24th time slots (see FIG. 8(SH)). Then, when the data for the channel ch1 is loaded into the 1st-stage delay circuit 67 at the 48th time slot in the second sampling period, the data for the channel ch4 that was loaded earlier is shifted to the 2nd-stage delay circuit 68. Thus the filter coefficient data for the channels ch1 to ch4 is loaded in order to the individual stages (delay circuits 67 to 70) of the shift register SR1. The rewriting of the filter coefficient data for the channels ch1 to ch4 is completed in the four periods of the timing signal LD or five sampling periods. The rewriting is repeated every five sampling periods. By the control thus effected, the channels ch1 to ch4 to which correspond the filter coefficients that appear in the outputs Q1, Q2, Q3, and Q4 from the respective stages (delay circuits 67 to 70) of the shift register SR1 in the 1st-stage filter unit L1 each occur as shown in FIG. 8 (SR1 of L1).

The signals SH and LD applied to the SHi and LDi inputs of the shift register SR1 are each serially delayed by one time slot and applied to the SHi and LDi inputs of the next-stage shift register SR2 and similarly in SR3 to SR8. Accordingly the variation patterns of the outputs Q1 to Q4 from the respective stages in the shift registers SR2 to SR8 are similar to those of SR1 shown in FIG. 8 (SR1 of L1) but the variation timings are each delayed by one time slot as compared with those in SR1 except that the variation timings (shift timings) in the shift register SR6 are two time slots behind those in SR5 since extra delay circuits 65 and 66 are provided between the shift registers SR5 and SR6. Thus the variation timings (shift timings) are serially shifted through the shift registers SR1 to SR8, with the delay of eight time slots in each filter unit. There is a 120-time-slot time delay from the time the signal "1" is supplied to the LDi input of the shift register SR1 in the first filter unit L1 until that signal "1", after having been serially delayed, is supplied to the LDi input of the last shift register SR8 in the filter unit L15. For example, the signal "1" based on the signal LD that occurred at the 24th time slot in the first sampling period is applied to the LDi input of the shift register SR8 in the filter unit L8 at the 48th time slot in the second sampling period. As shown KD in FIG. 8, the filter coefficient data for the channel ch4 is latched in the latch circuit 61 of the respective units L1–L15 from the 24th time slot in the first sampling period to the 47th time slot in the second sampling period. Therefore, the filter coefficient data for a channel (e.g., the channel ch4) can be serially loaded into the shift registers SR1 to SR8 in order with the shift register SR1 in the first filter unit L1 to the shift register SR7 all constructed in exactly the same manner as shown in FIG. 7. However, in order for the output of the latch circuit 61 not to shift to another channel when the signal "1" is applied to the LDi input of the last shift register SR8 in the filter unit L15, the output of the latch circuit (corresponding to 61 in FIG. 7) for the last shift register SR8 in the filter unit L15 is delayed by one time slot before being applied to the KDi input of the shift register SR8.

These elaborate data loading and shift control by the filter coefficient memory 64 (shift registers SR1 to SR8) in each of the filter units L1 to L15 enable the later-described time division serial calculation processing of a multi-channel tone signal to be carried out.

In the filter unit L1 shown in FIG. 7, the 4th-stage outputs Q4 (see FIG. 9) are taken out as outputs Q of the shift registers SR1 to SR8 and applied to the multiplier 51.

The serial tone signal FS inputted from the input terminal FS-IN is inverted by the inverter 86 and applied to the B input of the adder 48. The adder 48 is a full adder and its A input is supplied with the tone signal fed back through the delay circuit 53 from the next-stage filter unit L2. Co+1 is a carry-out output. A 1-time-slot delay elapses between the addition timing at which the carry-out signal occurs and the timing at which the signal "1" is outputted from the output Co+1. The output signal of the carry-out output Co+1 is inputted to the Ci input of the adder 48 through an OR gate 87. As shown in FIG. 3(*b*), the higher bits of the serial tone signal FS are assigned to the later time slots. Therefore, by adding the carry-out signal that was outputted from the output Co+1 one time slot behind to the Ci input, the carry-out signal can be added to the data which is higher by one bit. The other input to the OR gate 87 is supplied with the signal SH1 outputted from the 1st-stage delay circuit 136 of the delay circuit train 63. The signal SH1 is one time slot behind the timing signal SH that occurs as shown in FIG. 8 so as to be a "1" at the 25th, 49th, 73rd and first time slots. Since the serial tone signal FS inputted to the input terminal FS-IN through the line 16 occurs as shown in FIG. 3(*b*), the signal SH1 goes to "1" at a timing of the LSB of the serial tone signals for the channels ch1 to ch4 so that a "1" is repeatedly added at the LSB timing in the adder 48. This operation is performed to convert into a negative value the tone signal FS supplied from the input terminal FS-IN to the B input of the adder 48. Specifically, the tone signal FS is inverted by the inverter 86 and a "1" added to the LSB of the inverted signal, thereby converting it into a negative value in the two's complement form. The negative values of the tone signal FS supplied from the line 16 to the input terminal FS-IN are also expressed in the two's complement form. Accordingly, when the signal FS is a negative value, it is virtually converted into a positive value by the two's complement forming operation by the inverter 86 and signal SH1. Thus the adder 48 subtracts the tone signal amplitude data applied to the input terminal FS-IN from the fed-back tone signal amplitude data supplied to the A input through the feedback input terminal BS-IN and delay circuit 53.

The output of the adder 48 is inputted to a delay circuit 88 as well as to the data input of a latch circuit 89. The output signal of the adder 48 indicating the difference between the feedback tone signal and the input tone signal FS is delayed by the delay circuit 88 by 24 time slots and applied to an exclusive OR gate 90. The output of the exclusive OR gate 90 is applied to the A input of an adder 91. The delay circuit 88, latch circuit 89, exclusive OR gate 90 and adder 91 are provided to convert the output signal of the adder 48 expressed in the two's complement form into the sign and magnitude form (sign bit and absolute value).

The latch control input (L) of the latch circuit 89 is supplied with the timing signal SH. The signal of the SB is outputted from the adder 48 at the 24th, 48th, 72nd and 96th time slots at which time slots the signal SH occurs (see FIG. 3(*b*)) so that the SB value is latched in the latch circuit 89. The output of the latch circuit 89 is applied to the exclusive OR gate 90 and AND gate 92. For example, in the 24 time slots from the 25th to 48th time slots during which the latch circuit 89 outputs the SB for the channel ch1 that it latched at the 24th time slot, the delay circuit 88 outputs the signal for the channel ch1 that was outputted from the first to 24th time slots from the adder 48 but delayed by 24 time slots. The channels of the SB signal outputted from the latch circuit 89 and the signal from the delay circuit 88 coincide with each other. When the SB signal latched in the latch circuit 89 is a "0" or positive, the output signal of the delay circuit 88 passes the exclusive OR gate 90 as it is and, through the A input of the adder 91, outputted from the S output as it is. When the SB signal is a "1" or negative, the output of the delay circuit 88 is inverted by the exclusive OR gate 90. At the same time, an AND gate 92 is enabled by the output "1" of the latch circuit 89 and outputs the signal "1" at a timing of the signal SH1 and, accordingly, a "1" is applied to the Ci input of the adder 91 through an OR gate 93. The signal SH1 is the timing signal SH as delayed by one time slot and corresponds to the LSB. For example, in the period from the 25th to 48th time slots during which the delay circuit 88 outputs the signal for the channel ch1, the signal SH1 goes to 1 at the 25th time slot so that the adder 91 adds a "1" to the output signal for the LSB from the exclusive OR gate 90. The carry-out signal generated as a result of this addition is outputted from the Co+1 output one time slot later and applied to the Ci input through an AND gate 94 and OR gate 93. The other input to the AND gate 94 is supplied with a signal $\overline{SH1}$, the inverse of the SH1, from an inverter 95. At the LSB calculation timing, the AND gate 94 is disabled by a "0" of the signal $\overline{SH1}$ in order to inhibit the carry-out signal from the MSB for a channel at the preceding calculation timing. Thus a negative value expressed in the two's complement form is converted into the absolute value by the inversion at the exclusive OR gate 90 and addition of a "1" to the LSB.

By the construction described above, the signal FS' expressing the output signal of the adder 48 in the form of an absolute value is outputted from the S output of the adder 91. The states of the signal FS' in relation to the channels ch1 to ch4 are shown FS' in FIG. 8. As can be seen, the signal FS' is 24 time slots behind the input tone signal FS in timing. Similar to the signal FS shown in FIG. 3(*b*), the signal FS' is serial data of 24 bits (time slots) led by the LSB.

The multiplier 51 multiplies the 24-bit serial data FS' outputted from the adder 91 by the 8-bit filter coefficients outputted from the respective shift registers SR1 to SR8. The serial multiplication involving 24-bit data and 8-bit data generally requires the operation time for 32 time slots. However, since a time division operation for the individual channels must be performed every 24 time slots, the product involving the higher 24 bits including the sign bit SB is obtained, truncating the multiplication result involving the lower eight bits. The multiplier 51 comprises seven multiplier portions M1 to M7 corresponding respectively to the bits representing the absolute value portion of the filter coefficient outputted in parallel from the shift registers SR1 to SR7. These portions M1 to M7 are serially connected in order. The portions M4, M5, and M6, not shown in detail, are of the same construction as the portions M2 and M3.

The portions M1 to M7 respectively comprise AND gates 96, 97, 98 . . . 99 for obtaining partial products and to these AND gates are inputted, respectively, the bits k1, k2 . . . k7 representing the absolute value portion of the filter coefficient outputted from the shift registers SR1 to SR7. The portions M1 to M6 respectively comprise serially connected delay circuits 100, 101, 102 . . . which serially delay the output signal FS' of the adder 91, each by one time slot. The outputs of these delay circuits are applied to the AND gates 97, 98 . . . 99, respectively. The AND gate 96 of the portion M1 is supplied with the signal FS' not delayed. The portions M2 to M7 respectively comprise adders 103, 104 . . . 105 which add the partial products obtained by the AND gates 96 to 99. Since the signal FS' is delayed by the delay circuits 100, 101, 102 successively, the weights of the outputs from the AND gates 96 to 99 coincide with each other at each time slot so that the adders 103 to 105 may add partial products having the same weight.

The partial products of the individual bits, i.e., the outputs of the AND gates 97 to 99 are applied to the A input of the adders 103 to 105. The partial products or sums of the partial products are inputted to the B inputs through AND gates 106, 107, 108 . . . . The AND gate 106 is supplied with the output of the AND gate 96 and the output signal $\overline{SH1}$ of the inverter 95. The AND gates 107, 108 . . . are supplied with the outputs of the adders 103, 104 . . . and the signals obtained by delaying said signal $\overline{SH1}$ by delay circuits 109, 110, 111 . . . in order successively. These AND gates 106, 107, 108 . . . are provided to truncate the partial products of the lower bits. The carry-out outputs Co+1 of the respective adders 103, 104, . . . 105 are inputted to the carry-in input Ci through AND gates 113, 114 . . . 115. The other inputs of the AND gates 113, 114 . . . 115 are supplied with the signals each obtained by delaying the signal $\overline{SH1}$ by the delay circuits 109, 110, 111 . . . in order successively. While the AND gates 113, 114 . . . 115 enable the addition of carry-out signals for the same channel to be performed, they also serve to prevent the carry-out signal of the MSB for a channel at the preceding calculation timing from being added to the LSB for the following channel.

Delay circuits 116, 117 and 118 are provided between the portions M5 and M6 to compensate for the calculation delay of the AND gates 106, 107, 108 . . . and adders 103, 104 . . . in the portions M1 to M5. The sum of the calculation time delay in these portions M1 to M5 (shorter than one time slot) are adjusted to one time slot delay by the delay circuit 117 for synchronism with the change of time slots. Further, the delay circuit 116 is inserted in the line of the delay circuits 100, 101, 102 . . . while the delay circuit 118 in the line of the delay circuits 109, 110, 111 . . . for synchronism. Also, to keep pace with this delay, the extra delay circuits 65 and 66 are inserted in the delay circuit trains 62 and 63 respectively.

Thus the adder 105 in the portion M7 outputs serial data corresponding to the product of the signal FS' and the absolute-value part (bits k1 to k7) of the filter coefficient. The output of the adder 105 is applied to the A input of an adder 120 through an exclusive OR gate 119. The exclusive OR gate 119 and adder 120 are provided to convert the product of the respective sign bits of the signal FS' and the filter coefficient into the two's complement form in response to the multiplication result. The data k8 representing the filter coefficient sign bit SB is inputted to the exclusive OR gate 121 from the shift register SR 8. The SB of the signal FS' is latched in the latch circuit 89. A latch circuit 122, provided to synchronize the output signal of the latch circuit 89 with the output of the shift register SR8, latches the output of the latch circuit 89 at the timing when the 8th-stage delay circuit 123 in the delay circuit train 63 goes to 1. The output of the latch circuit 122 is supplied to the other input of the exclusive OR gate 121. Since the latch timing of the latch circuit 122 and the shift timing of the shift register SR8 synchronize with each other, the respective sign bit data of a filter coefficient and signal FS' for the same channel are inputted to the exclusive OR gate 121 in synchronism. The exclusive OR gate 121 outputs the signal "1" indicating "negative" when the sign bits do not coincide with each other and the signal "0" indicating "positive" when they coincide. When the output of the exclusive OR gate 121 is a "0", meaning the sign of the product is positive, the output of the adder 105 is passed through the exclusive OR gate 119 and adder 120 as it is and applied to the AND gate 124. When the output of the exclusive OR gate 121 is a "1", meaning that the sign of the product is negative, the output of the adder 105 is inverted by the exclusive OR gate 119 and applied to the A input of the adder 120. When the output of the exclusive OR gate 121 is a "1", an AND gate 125 supplies a "1" through an OR gate 126 to the Ci input of the adder 120 at the LSB timing as will be described later. Thus a negative product is converted into the two's complement form.

The product expressed in the two's complement form is supplied from the adder 120 through the AND gate 124 and OR gate 127 to the A input of the adder 49. It is noted that AND gates 128 and 129 which control the supply of the carry-out outputs Co+1 of the adders 120 and 49 to the carry-in inputs Ci are provided for the same purpose as the AND gates 113, 114 . . . .

The loop consisting of an OR gate 130 supplied with the output of the adder 105, an AND gate 131, and delay circuit 132 is provided to detect whether the bits of the product are all "0". The signal $\overline{SH8}$ obtained by delaying the signal $\overline{SH1}$ by seven time slots is applied to the AND gate 131. The stored contents in the loop is reset by the signal $\overline{SH8}$. When the output of the adder 105 went to "1" even once, a "1" is stored in the loop 130, 131, 132. When the output of the adder 105 did not go to "1" at all, that is, the product was all "0", a "1" is not stored but a "0" remains in the loop 130, 131, 132. The outputs of the delay circuit 132 and exclusive OR gate 121 are inputted to an AND gate 133. When the product is not all "0", the output of the exclusive OR gate 121, i.e., the product of the sign bits, passes the AND gate 133 as it is. When the product is all "0", the AND gate 133 is disabled so that its output is a "0" (indicating the positive sign) whatever the output of the exclusive OR gate 121 may be. The output of the AND gate 133 is applied through an AND gate 134 and an OR gate 127 to the A input of the adder 127. The AND gate 134 is only enabled at the sign bit timing by the signal obtained by inverting the signal $\overline{SH8}$ by the inverter 135. Thus the output of the AND gate 133 indicates the sign bit of the product, the sign bit being forced to "0" or positive state when the product is all "0".

Figure 10:
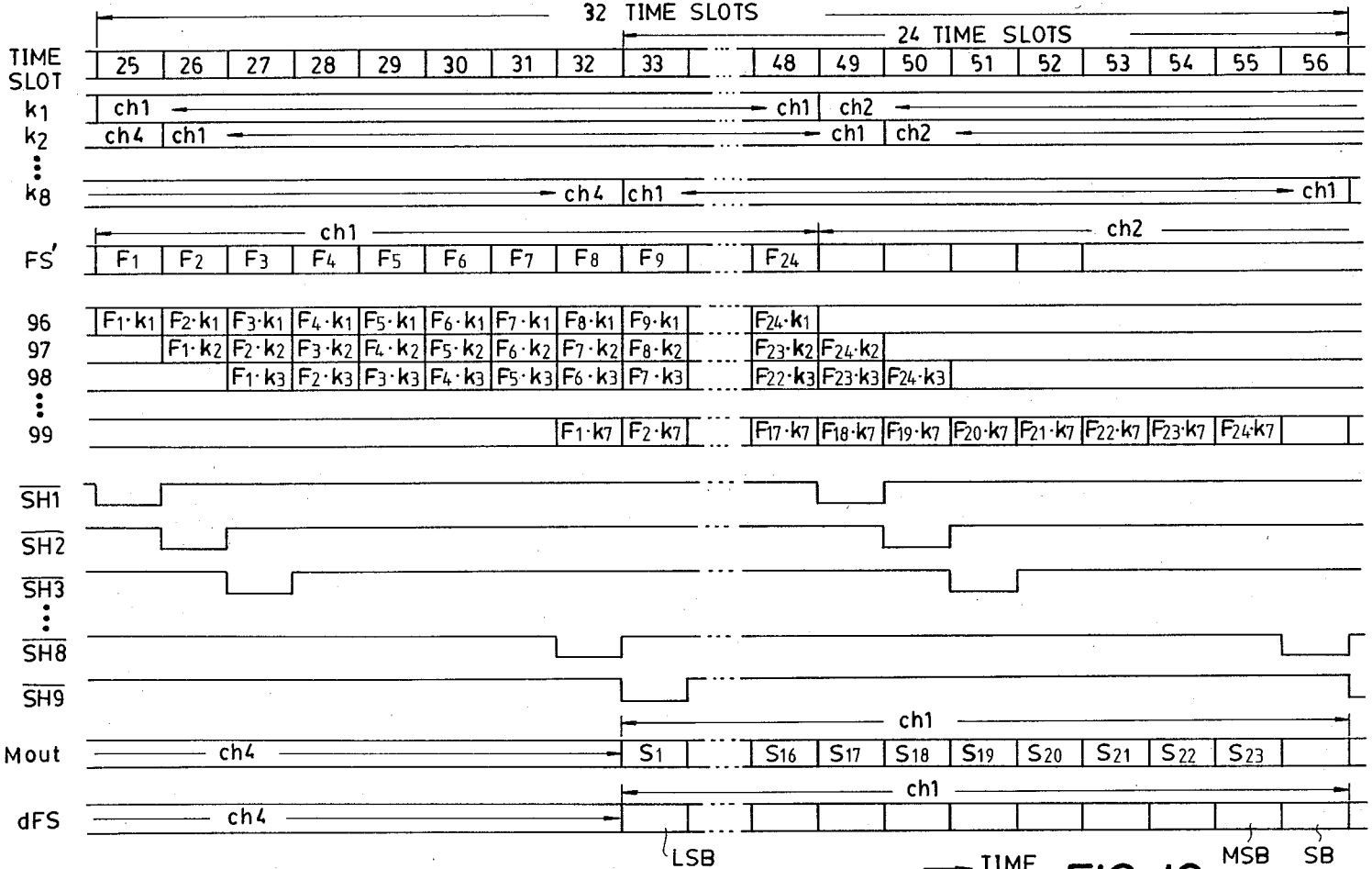
FIG. 10 is a time chart showing an example of serial multiplication operation of a multiplier shown in FIG. 7.

The calculation operation will now be described in detail with reference to FIGS. 7 and 10. FIG. 10 indicates the 25th to 56th time slots of the first sampling period. Using the 32 time slots shown, multiplication of the 24-bit signal FS' and 8-bit filter coefficient for the channel ch1 is carried out. However, in the first eight (25th to 32nd) of the 32 time slots which are also the calculation timing of the higher bits for the channel ch4 that precedes the channel ch1, the priority is given to the calculation relating to the channel ch4, truncating the calculation for the channel ch1. Therefore, the multiplication for the channel ch1 is virtually carried out during the 24 time slots form the 33rd to 56th time slots.

k1 to k8 in FIG. 10 shows the states of the bits k1 to k8 of the filter coefficient outputted in parallel from the shift registers SR1 to SR8, in respect of the channels ch1 to ch4. As shown L1-SR-Q4 in FIG. 8 also, the LSB k1 of the filter coefficient outputted from the shift register SR1 covers the channel ch1 from the 25th to 48th time slots and shifts to the channel ch2 at the 49th time slot. As described before, since the shift timings of the respective shift registers SR1 to SR8 are serially stepped by one time slot, the bit k2 outputted from the shift register SR2 shifts to the channel ch1 at the 26th time slot and k3 to k7, though not shown in FIG. 10, at the 27th, 28th, 29th, 31st and 32nd time slots respectively. The bit k8 outputted from the shift register SR8 shifts to the channel ch1 at the 33rd time slot. It is noted that the bit k6 outputted from the shift register SR6 shifts to the channel ch1 at the 31st time slot instead of the 30th time slot because the extra delay circuits 65 and 66 are provided.

FS' in FIG. 10 shows the state of the signal FS' outputted serially from the adder 91. As shown also FS' in FIG. 8, the signal FS' covering the channel ch1 is outputted during the 24th time slots from the 25th to 48th time slots. FIG. 10 shows the timings of the respective bits F1 to F24 of the signal FS' for the channel ch1, F1 being the LSB.

96 to 99 in FIG. 10 shows the states of the partial product calculation performed at every time slot by the partial product calculation AND gates 96 to 99 of the respective multiplier portions M1 to M7. For example, "F1·k1" indicates the multiplication of the LSB F1 of the signal FS' by the LSB k1 of the filter coefficient. As will be seen, the AND gate 96 of the portion M1 multiplies the respective bits F1, F2, F3 . . . F24 of the signal FS' successively supplied in order from the lower bits by the LSB k1 of the filter coefficient at all times. The timing at which the bit k1 shifts to the channel ch1 coincides with the timing at which the LSB of the signal FS' for the channel ch1 is applied to the AND gate 96 and, at that timing, i.e., the 25th time slot, the AND gate 96 outputs the partial product F1·k1. Therefore, in the 24 time slots (from the 25th to 48th time slots) during which the bit k1 retains a value for the channel ch1, the AND gate 96 successively finds the partial products F1·k1 to F24·k1 of the respective bits F1 to F24 of the signal FS' and the LSB k1 of the filter coefficient as shown in FIG. 10. Multiplication of the signal FS' by the other bits k2 to k7 of the filter coefficient is likewise performed by the AND gates 97 to 99 in the respective portions M2 to M7. However, the calculation timings are serially stepped as shown in FIG. 10 because the signal FS' is serially delayed by the delay circuits 100, 101, 102 . . . before it is multiplied by the respective bits k2 to k7.

FIG. 10 ($\overline{SH1}$ to $\overline{SH9}$) shows the states of the signals $\overline{SH1}$ and $\overline{SH2}$ to $\overline{SH9}$ obtained by serially delaying the signal $\overline{SH1}$ by the delay circuits 109, 110, 111 . . . 112. The signal $\overline{SH2}$ outputted from the delay circuit 109 is one time slot behind the signal $\overline{SH1}$ and the signal $\overline{SH3}$ outputted from the delay circuit 110 is two time slots behind the signal $\overline{SH1}$. The signal $\overline{SH8}$ outputted from the delay circuit (not shown) in the portion M6 is obtained by delaying the signal $\overline{SH1}$ by seven time slots using the delay circuits 109, 110, 111 . . . in the respective portions M1 to M6 and the delay circuit 118. The signal $\overline{SH9}$ outputted from the delay circuit 112 in the portion M7 is obtained by delaying the signal $\overline{SH8}$ by another one time slot.

At the 25th time slot, the signal $\overline{SH1}$ in the "0" state disables the AND gate 106 in the portion M1 so as to truncate the partial product F1·k1 outputted from the AND gate 96. At that time, the portions M2 to M7 find the partial products relating to the channel ch4 that precedes in the calculation timing so the multiplier 51 outputs the multiplication result relating to the channel ch4.

At the following 26th time slot, the signal $\overline{SH2}$ in the "0" state disables the AND gate 107 in the portion M2 so as to truncate the output of the adder 103 that is the sum of the partial product F2·k1 outputted from the AND gate 96 and the partial product F1·k2 outputted from the AND gate 97. At that time, the portions M3 to M7 find the partial products relating to the channel ch4 so that the multiplier 51 outputs the multiplication results relating to the channel ch4.

Thus, up to the 31st time slot, the multiplication results relating to the channel ch1 are truncated by the delay signals $\overline{SH3}$ . . . of the signal $\overline{SH1}$. At the 31st time slot, the output of the adder (not shown) in the portion M6 is inhibited by the signal $\overline{SH7}$ (not shown) obtained by delaying the signal $\overline{SH1}$ by six time slots. At that time, the adder in the portion M6 outputs the sum of the partial product F6·k1+F5·k2+F4·k3+F3·k4+F2·k5+F1·k6. Referring to FIG. 10, the partial products F6·k1, F5·k2, F4·k3 . . . are produced at the 30th time slot. However, since the sum of the partial products yielded by the portions M1 to M5 is delayed by one time slot by the delay circuit 117, the sum is outputted from the portion M6 at the 31st time slot.

At the 32nd time slot, the multiplication results relating to the channel ch1 is not truncated in the portions M1 to M7. Therefore, the adder 105 in the portion M7 outputs the sum of the partial products F7·k1+F6·k2+F5·k3+ . . . F1·k7. However, the output of the adder 105 is inputted through the exclusive OR gate 119 and the adder 120 to the AND gate 124 and inhibited by the signal $\overline{SH8}$ in the "0" state that is applied to the other input of the AND gate 124. Therefore the multiplication result relating to the channel ch1 is also truncated at the 32nd time slot. As described before, until the 32nd time slot, the adder 51 (specifically, the OR gate 127 that is the output circuit of that adder) outputs the multiplication results relating to the channel ch4 that precedes in the calculation timing.

From the 33rd to 48th time slots, the signals SH1 to SH8 are all in the "1" state so that the AND gates 106, 107, 108 . . . 124 are all abled. During this period, therefore, the adder 51 outputs the sum of all the partial products relating to the channel ch1 that were obtained in the portions M1 to M7. While the signals $\overline{SH1}$ to $\overline{SH8}$ successively go to "0" from the 49th to 56th time slots, this is to truncate the partial products relating to the following channel ch2 and the adder 51 does not fail to output the multiplication results relating to the channel ch1. Accordingly, the adder 51 virtually outputs the multiplication results relating to the channel ch1 during the 24 time slots from the 33rd to 56th time slots.

FIG. 10 (Mout) illustrates the timings of the bits S1 to S23 of the serial multiplication output relating to the channel ch1. As will be apparent from the above description, the LSB S1 of the multiplication result outputted at the 33rd time slot equals the sum of the partial products as given below together with those for S2, S3, . . . S21, S22 and S23.

$$S1 = F8 \cdot k1 + F7 \cdot K2 + F6 \cdot K3 + \ldots + F2 \cdot k7$$
$$S2 = F9 \cdot k1 + F8 \cdot k2 + F7 \cdot k3 + \ldots + F3 \cdot k7$$
$$S3 = F10 \cdot k1 + F9 \cdot k2 + F8 \cdot k3 + \ldots + F4 \cdot k7$$
$$S21 = F24 \cdot k5 + F23 \cdot k6 + F22 \cdot k7$$
$$S22 = F24 \cdot k6 + F23 \cdot k7$$
$$S23 = F24 \cdot k7$$

It is noted that the MSB F24 of the signal FS' corresponds to the sign bit of the output of the adder 48 which, when positive, is passed through the exclusive OR gate 90 as it is, i.e., "0" and, when negative, its "1" state is inverted by the exclusive OR gate 90 to the "0" state. F24 therefore remains "0" all the time.

As will be seen from FIG. 10, the signal $\overline{SH9}$ goes to "0" at a timing of the LSB S1 of the multiplication output. Therefore, by having the signal $\overline{SH9}$ inverted by the inverter 137 and then inputted to the AND gate 125, it is possible to perform the addition of "1" to the LSB for the two's complement forming operation by the adder 120.

The signal $\overline{SH8}$ is inputted to the AND gate 131 in the loop 130, 131, 132 provided for all-"0" detection. As shown in FIG. 10, the signal $\overline{SH8}$ goes to "0" immediately before the LSB S1 of the multiplication output. Therefore, the loop 130, 131, 132 is reset (e.g. at the 32nd time slot) immediately before the adder 105 outputs a new multiplication result. In case the multiplication result outputted from the adder 105 is all 0, the delay circuit 132 still outputs the signal "0" at the time slot (e.g. the 56th time slot) immediately following the output timing of the MSB S23 of the multiplication output. Whether the multiplication result is all "0" or not is thus known accurately at the time slot immediately following the timing of the LSB S23 of the serial multiplication output. At that time, the AND gate 134 is enabled by the inverted signal from the inverter 135 of the signal $\overline{SH8}$ so as to select the data representing the sign bit of the multiplication output. As before, that the sign bit data corresponds normally to the output signal of the exclusive OR gate 121 but is forced to "0" by the signal 0 of the delay circuit 132 when the multiplication output is all "0".

Thus the output of the adder 51 applied to the A input of the adder 49 through the OR gate 127 is a 23-bit serial data S1 to S23 occurring in order from the LSB and followed by the sign bit. The multiplication output data S1 to S23 for a negative value is represented in the two's complement form.

The tone signal dFS supplied from the delay circuit 52 to the B input of the adder 49 meanwhile is shown in FIG. 10. As the tone signal FS for the channel ch1 applied to the input terminal FS-IN from the first to 24th time slots is delayed by 32 time slots by the delay circuit 52, the tone signal dFS for the channel ch1 is outputted from the delay circuit 52 from the 33rd to 56th time slots. Therefore, the channels of the signals applied to the A and B inputs of the adder 49 coincide with each other and it is possible to add the multiplication output and the tone signal of the same channel. Assuming that the LSB of the tone signal (having the same weight as the bit F1 of the signal FS') has a weight of decimal 1, the LSB S1 of the output of the multiplier 51 also has a weight of decimal 1. As before, the bit S1 is the sum of the partial products F8·k1+ . . . +F2·k7. Referring to the partial product F2·k7 in particular, the bit F2 has a weight of decimal 2 because it is one bit more significant than the bit F1 and, since F2·k7 has a weight of decimal 1, the bit k7 has a weight of decimal 0.5. Thus the calculation processing is effected so that the LSB k7 of the filter coefficient k1 to k7 has a weight of 0.5. This means that the absolute value of the filter coefficient is smaller than 1.

The output of the adder 49 is inputted through the output terminal FS-OUT to the next-stage filter unit L2. The filter unit L2 performs the same operation as mentioned before based on the tone signal supplied from the preceding filter unit L1 through the input terminal (corresponding to FS-IN shown in FIG. 7) of the unit L2, the filter coefficient stored in the shift registers (corresponding to SR1 to SR8 shown in FIG. 7), etc. However, while there is a 32-time slot delay in the tone signal between the input terminals FS-IN and output terminals FS-OUT of the respective filter units L1 to L15, there is an 8-time-slot delay in the timing signals LS and SH between the same terminals. If, therefore, the units L2 to L15 were all of the same construction as the unit L1, discrepancy would result in the channels of the filter coefficient k1 to k8 and the signal FS' in the multiplier (corresponding to 51 in FIG. 7). In order to register the channels of the filter coefficient k1 to k8 and the signal FS' in the multipliers (corresponding to 51 in FIG. 7) of the respective units L1 to L15, the outputs Q of the shift registers SR1 to SR8 are each taken out at the different stages of these shift registers, depending on the filter units L1 to L15. Specifically, the 4th-stage outputs Q4 (see FIG. 9) of the shift registers SR1 to SR8 are taken out as outputs Q in the unit L1, the 1st-stage outputs Q1 in the unit L2, the 2nd-stage outputs Q2 in the unit L3, the 3rd-stage outputs Q3 in the unit L4, the 4th-stage outputs Q4 in the unit L5 and so on, thereby successively stepping the stages at which the outputs Q are taken out.

Figure 11:
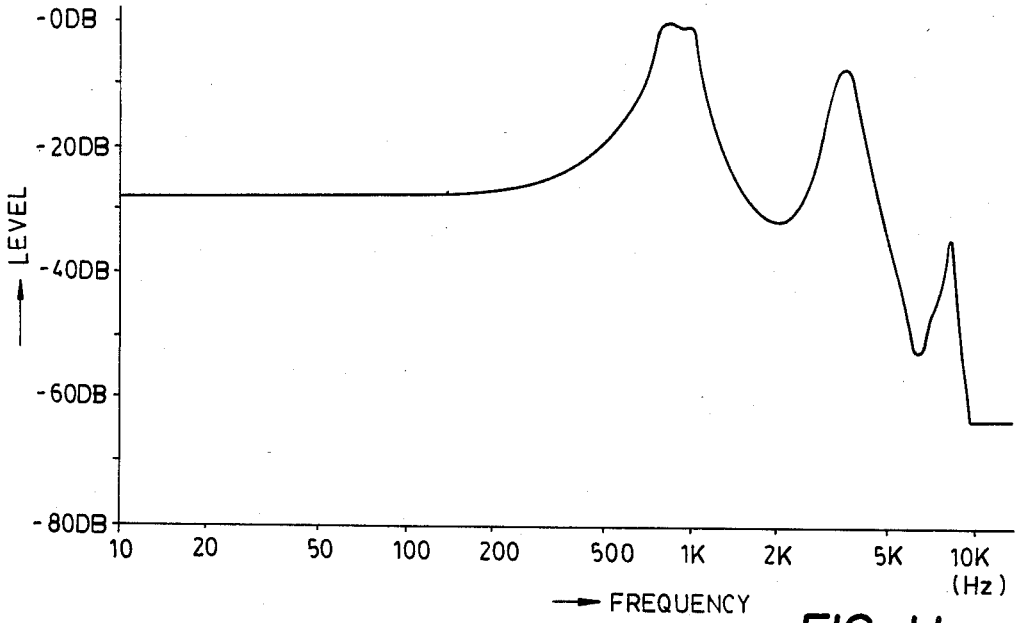
FIG. 11 is a graph showing an example of a filter characteristic which can be realized by a digital filter.

FIG. 11 illustrates an example of the filter characteristics realized by the digital filter units L1 to L15 as described above. The filter characteristic shown is realized by setting a 120-bit filter coefficients group K at a given state. The digital filters can realize complicated filter characteristics such as this example. Besides, desired filter characteristics may be obtained by varying the value of the filter coefficients.

Figure 12:
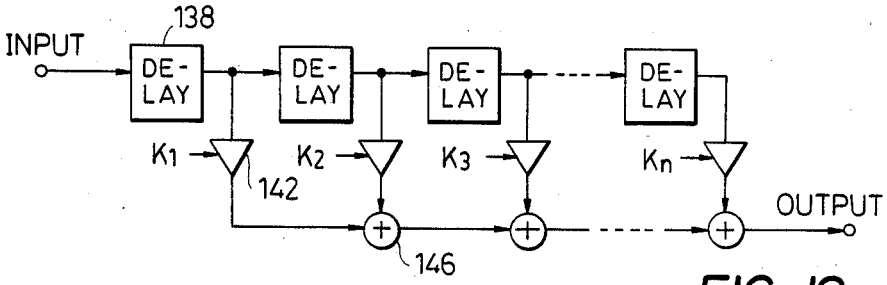
FIG. 12 is a block diagram showing a basic form of a finite impulse response filter applicable to the filter unit of FIG. 2.
Figure 13:
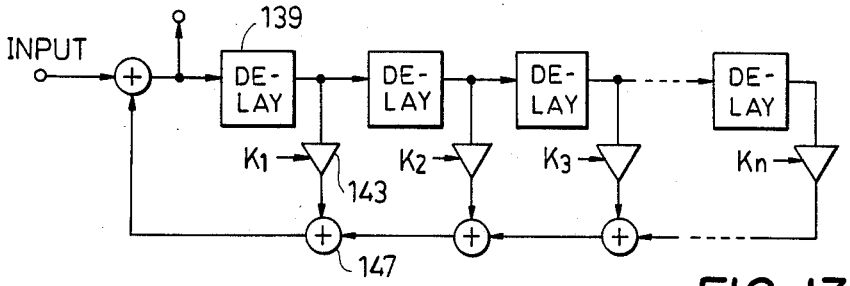
FIG. 13 is a block diagram showing a basic form of an infinite impulse response filter applicable also to the filter unit of FIG. 2.
Figure 14:
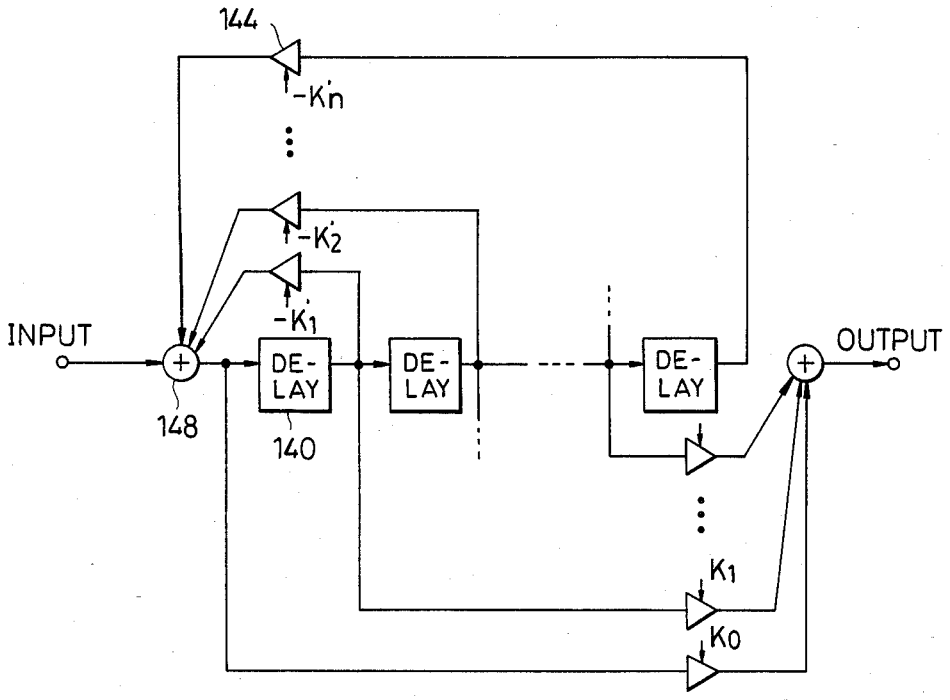
FIGS. 14 and 15 are block diagrams respectively showing examples of a high order circulating type filter applicable to the filter unit of FIG. 2.
Figure 15:
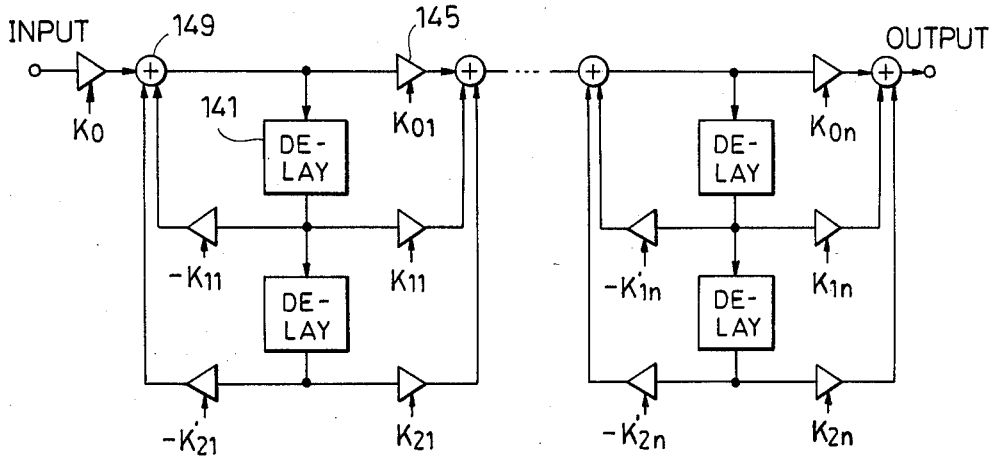

FIG. 12 shows a basic configuration of the FIR filter and FIG. 13, of the IIR filter. These FIR or IIR filters or a combination of them may be used for the filter units L1 to L15 in the filter section 14. Alternatively, the filter units L1 to L15 may be embodied by the high order circulating type filters (a kind of IIR filters) as shown in FIGS. 14 and 15. In FIGS. 12 to 15, the blocks indicated "delay" such as those numbered 138, 139, 140 and 141 are delay circuits, the triangular blocks such as those numbered 142, 143, 144 and 145 multipliers and the blocks with the symbol + therein such as those numbered 146, 147, 148 and 149 adders. K1, K2, K3, . . . , Kn, −K'1, −K'2 . . . −K'n, K01, K11, . . . inputted to the multipliers 142, 143, 144, 145 . . . are filter coefficients. The peripheral circuits about the respective multipliers 142, 143, 144, 145 . . . are of course of a configuration capable of multi-channel time-division serial calculation as in the case of the multiplier 51 and its peripheral circuits SR1 to SR8 . . . shown in FIG. 7.

We claim:

1. A digital filter system in an electronic musical instrument comprising:

tone signal supply means for timewisely serially supplying digital tone signals consisting of successive musical tone sample point amplitudes each represented by a plural bit digital value, each such value being delivered bit serially on a single line;

filter coefficient supply means for timewisely bit serially supplying plural bit filter coefficients which establish a tone color; and calculation means for implementing a predetermined filter operation by performing mathematical operations in bit-serial fashion on said bit serially delivered sample point amplitudes supplied by said tone signal supply means and the bit serially supplied filter coefficients from said filter coefficient supply means to produce bit serially outputted tone signals which are filter-controlled in response to said filter coefficients.

2. A digital filter system as defined in claim 1 wherein:

said tone signal supply means supplies sample point amplitudes of a plurality of channels in time division multiplexed order with respect to said channels;

said filter coefficient supply means supplies filter coefficients of a plurality of channels in time division multiplexed order among the respective channels; and said calculation means comprising:

a coefficient supply control circuit which receives the serial filter coefficients supplied by said filter coefficient supply means, converts the serial filter coefficients to parallel filter coefficients, stores the parallelly converted filter coefficients channel by channel, and delivers out the stored filter coefficients of the respective channels in synchronism with time division multiplex timings of the sample point amplitudes corresponding to the respective channels, and a serial calculation circuit which receives the bit serially supplied sample point amplitudes from said tone signal supply means and the filter coefficients delivered by said coefficient supply control circuit, carries out a filter operation for the respective channels in time division in accordance with the serial sample point amplitudes and the filter coefficients and thereby obtains filter-controlled tone signals for the respective channels in time division.

3. A digital filter system as defined in claim 2 wherein said coefficient supply control circuit comprises:

a parallel conversion circuit which receives the serial filter coefficients supplied by said filter coefficient supply means and, each time the serial filter coefficients for one channel have been received, latches these filter coefficients in parallel; and a coefficient memory circuit which includes shift registers corresponding to respective bits of the filter coefficients, each of said shift registers having stages corresponding to the number of channels and, each time the filter coefficients of one channel have been latched by said parallel conversion circuit, causes outputs of these parallel conversion circuit to be loaded in a predetermined stage of each of the shift registers and shift controls said shift registers during each time required for serially delivering out the tone signals of one channel.

4. A digital filter system as defined in claim 3 wherein said coefficient memory circuit carries out the loading and the shift control with load timings and shift timings in the respective shift registers being successively stepped in synchronism with outputting time slots of respective bit data.

5. A digital filter system as defined in claim 1 wherein said filter coefficient supply means comprises:

an internal memory which prestores a plural sets of filter coefficients and timewisely serially provides a set of filter coefficients in accordance with a tone selection signal, an external memory which stores desired filter coeffieicnts and timewisely serially provides these stored filter coefficients and a selection device which selects either of the filter coefficients provided by said internal memory and said external memory and supplies the selected filter coefficients to said calculation means.

6. A digital filter system as defined in claim 1 wherein the filter operation in said calculation means is carried out on the basis of mathematical operations which implement a lattice type digital filter.

7. A digital filter system as defined in claim 6 wherein said calculation means comprises serially connected filter units as a circuit for the filter operation and each of said filter units includes a first delay circuit which delays a signal fed back from a filter unit of a next stage by a predetermined time, a first adder which receives a tone signal from a filter unit of a preceding stage and subtracts the input tone signal from an output signal of said first delay circuit, a multiplier which multiplies an output signal of said first adder with said filter coefficients, a second delay circuit which delays the input tone signal by a time length corresponding to a delay in calculation in said multiplier, a second adder which adds outputs of said multiplier and said second delay circuit together, a third delay circuit which delays an output signal of said first delay circuit by a time length corresponding to a delay in calculation in said multiplier and a third adder which adds output signals of said third delay circuit and said multiplier together and feeds back an addition output thereof to a filter unit of a preceding stage, the delay time in said first delay circuit is a period of time obtained by subtracting time which is double the delay time in the calculation in said multiplier from one sampling period of said digital tone signal.

8. An electronic musical instrument comprising:

keyboard means having a plurality of keys;

tone signal generating means for bit-serially generating in real time a digital tone signal corresponding to a depressed key among said keys, said digital tone signal being in the form of successive sample point values each of plural bits delivered bit-serially on a single line;

tone color setting means for setting a tone color of a tone to be produced;

filter coefficient generating means for bit-serially generating filter coefficients corresponding to said setted tone color, each of said filter coefficients being in the form of bit-serial;

digital filtering means connected to said tone signal generator and said filter coefficient means for bit-serially performing in real time a digital filtering operation of said digital tone signal in accordance with said filter coefficients; and sound means for producing a tone corresponding to said filtered tone signal, said setted tone color being imparted to said tone.

9. An electronic musical instrument according to claim 8 wherein said digital filtering means comprises a lattice type digital filter.

10. An electronic musical instrument according to claim 8 wherein said digital filtering means comprises multiplying means for bit-serially performing multiplication and adding means for bit-serially performing addition.

11. An electronic musical instrument according to claim 8 wherein said tone color setting means comprises tone color signal generating means for generating tone color signal corresponding to said setted tone color and wherein said filter coefficent generating means comprises memory means for storing said filter coefficients and read out means for reading out said filter coefficients by accessing said memory means based on said tone color signal.

12. An electronic musical instrument comprising:

keyboard means having a plurality of keys;

tone signal generating means having a plurality of tone production channels for bit-serially delivered on a single line digital tone signals assigned to said channels and corresponding to a depressed key or keys among said keys in time-division-multiplexed mode, each of said digital tone signals being in bit serial form and being delivered at a rate corresponding to the frequency of the tone to be produced therefrom;

tone color setting means for setting tone colors of tones to be produced;

filter coefficient generating means for bit-serially generating sets of filter coefficients corresponding to said setted tone colors in time-division-multiplexed mode, each of said filter coefficients being in bit-serial form;

digital filtering means connected to said tone signal generating means and said filter coefficient means for bit-serially performing a digital filtering operation on said delivered digital tone signals in accordance with said sets of filter coefficients; and sound means for producing tones corresponding to said filtered digital tone signals, said setted tone colors being imparted to said tones respectively.

13. An electronic musical instrument according to claim 12 wherein said digital filtering means comprises a lattice type digital filter.

14. An electronic musical instrument according to claim 12 wherein said digital filtering means comprises multiplying means for bit-serially performing multiplication and adding means for bit-serially performing addition.

15. An electronic musical instrument according to claim 12 wherein said tone color setting means comprises tone color signal generating means for generating tone color signals corresponding to said setted tone colors and wherein said filter coefficient generating means comprises memory means for storing said sets of filter coefficients and read out means for reading out said sets of filter coefficients by accessing in time-division-multiplexed mode said memory means based on said tone color signals.

16. An electronic musical instrument comprising:

keyboard means having a plurality of keys;

tone signal generating means connected to said keyboard means for generating a musical tone signal having a pitch designated by a depressed one among said keys, said musical tone signal consisting of successive sample point amplitudes each being represented by a plural bit digital code supplied bit-serially on a single line;

filter coefficient supply means for bit-serially supplying a filter coefficient represented by a plural bit digital code;

digital filtering means for bit-serially receiving said musical tone signal and said filter coefficient, for filtering said musical tone signal in accordance with said filter coefficient on a bit-by-bit basis in time synchronism with the bit-serial supply of said musical tone signal, and for bit-serially outputting a filtered musical tone signal represented by a plural bit digital code; and sound means for producing a musical tone corresponding to said filtered musical tone signal, said sample point amplitude musical tone signals being supplied and filtered by said digital filtering means continually in real time as said musical tone is being produced by said sound means.

17. In an electronic musical instrument, a fixed formant digital filter operative in real time to digitally filter successive musical tone sample point amplitudes supplied sequentially in bit serial digital format, comprising:

a plurality of serially connected filter units each adapted for implementing a filter function by bit serially performing mathematical operations on said tone waveshape sample point amplitudes as they are serially supplied in real time to the input of said serially connected filter units, said sample point amplitude values being modified by said mathematical operations during serial propagation through said filter units, means for supplying successive bits of a set of multibit filter coefficients in sequence to each of said serially connected filter units in synchronism with the propagation therethrough of said sample point amplitude values, said serially connected filter units thereby performing said mathematical operations serially on the amplitude sample point values being propagated therethrough in accordance with said serially supplied filter coefficients so as to implement said fixed formant digital filter, the bit serial data emergent from the last of said serially connected filter units constituting successive sample point amplitude values of a musical tone to which fixed formant characteristics have been imparted by said digital filter.

18. A digital filter system in an electronic musical instrument according to claim 1 further comprising musical sound production means for producing musical sounds from said outputted filter-controlled tone signals, and wherein said sample point amplitudes are supplied by said tone signal supply means in real time concurrently as said musical sounds are produced by said musical sound production means.

* * * * *